US008040302B2

(12) United States Patent
Shin

(10) Patent No.: US 8,040,302 B2
(45) Date of Patent: Oct. 18, 2011

(54) DISPLAY WITH MULTIPLE PIXELS SHARING A DATA LINE AND DRIVING METHOD THEREOF

(75) Inventor: Dong-Yong Shin, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1186 days.

(21) Appl. No.: 11/128,924

(22) Filed: May 13, 2005

(65) Prior Publication Data

US 2005/0264496 A1 Dec. 1, 2005

(30) Foreign Application Priority Data

May 25, 2004 (KR) ..... 10-2004-0037266
May 28, 2004 (KR) ..... 10-2004-0038260
May 28, 2004 (KR) ..... 10-2004-0038261

(51) Int. Cl.
*G09G 3/32* (2006.01)

(52) U.S. Cl. ..... 345/82

(58) Field of Classification Search ..... 345/204–215, 345/690–699, 87–111, 173, 76, 82; 315/169.1–169.3
See application file for complete search history.

(56) References Cited

U.S. PATENT DOCUMENTS 6,421,033 B1 * 7/2002 Williams et al. ..... 345/55
6,618,031 B1 * 9/2003 Bohn et al. ..... 345/83
6,707,441 B1 * 3/2004 Hebiguchi et al. ..... 345/92
6,958,741 B2 10/2005 Tsutsui
7,113,154 B1 9/2006 Inukai
7,129,643 B2 10/2006 Shin et al.
7,256,775 B2 * 8/2007 Eom ..... 345/204
2002/0074551 A1 6/2002 Kimura
2002/0154085 A1 * 10/2002 Kim ..... 345/96
2002/0163493 A1 * 11/2002 Matsushima et al. ..... 345/98
(Continued)

FOREIGN PATENT DOCUMENTS

CN 1455914 A 11/2003
(Continued)

OTHER PUBLICATIONS

Patent Abstracts ofJapan, Publication No. 09-138659, dated May 27, 1997, in the name of Chan-Long Shieh et al.

(Continued)

*Primary Examiner* — Chanh Nguyen
*Assistant Examiner* — Long Pham
(74) *Attorney, Agent, or Firm* — Christie, Parker & Hale, LLP

(57) ABSTRACT

In an organic light emitting display, a first pixel and a second pixel share a data line, a select scan line, and a driving element, and a field is divided into first and second subfields. An organic light emitting element of the first pixel is driven by a first emission control signal transmitted to a first emit scan line, and an organic light emitting element of the first pixel is driven by a second emission control signal transmitted to a second emit scan line. The first emission control signal has a low-level pulse in the first subfield, the second emission control signal has a low-level pulse in the second subfield, and a select signal transmitted to the select scan line has a low-level pulse in each of the first and second subfields. In addition, a scan driver for driving the select signal line, the first emit scan line, and the second emit scan line is provided.

14 Claims, 32 Drawing Sheets

U.S. PATENT DOCUMENTS

| | | | | |
|---|---|---|---|---|
| 2003/0107560 | A1* | 6/2003 | Yumoto et al. | 345/204 |
| 2003/0117352 | A1* | 6/2003 | Kimura | 345/87 |
| 2003/0132931 | A1* | 7/2003 | Kimura et al. | 345/212 |
| 2003/0189559 | A1* | 10/2003 | Lee et al. | 345/204 |
| 2003/0227262 | A1 | 12/2003 | Kwon | |
| 2004/0217935 | A1* | 11/2004 | Jeon et al. | 345/100 |
| 2004/0239658 | A1* | 12/2004 | Koyama et al. | 345/204 |
| 2005/0104823 | A1* | 5/2005 | Giraldo et al. | 345/87 |
| 2005/0237001 | A1 | 10/2005 | Hayafuji | |
| 2005/0259095 | A1 | 11/2005 | Kwak | |
| 2005/0264497 | A1* | 12/2005 | Shin et al. | 345/76 |

FOREIGN PATENT DOCUMENTS

| | | | |
|---|---|---|---|
| CN | 1458641 | A | 11/2003 |
| CN | 1467696 | | 1/2004 |
| CN | 1577442 | | 2/2005 |
| EP | 1 536 406 | | 6/2005 |
| JP | 62-187887 | | 8/1987 |
| JP | 03-085591 | | 4/1991 |
| JP | 04-355789 | | 12/1992 |
| JP | 09-138659 | A | 5/1997 |
| JP | 11-038379 | | 2/1999 |
| JP | 2000-347628 | | 12/2000 |
| JP | 2002-244619 | | 8/2002 |
| JP | 2002-268615 | | 9/2002 |
| JP | 2002-352593 | | 12/2002 |
| JP | 2003-022058 | | 1/2003 |
| JP | 2003-510661 | T | 3/2003 |
| JP | 2003-101394 | | 4/2003 |
| JP | 2003-108070 | | 4/2003 |
| JP | 2003-122306 | A | 4/2003 |
| JP | 2003-140619 | | 5/2003 |
| JP | 2003-141893 | | 5/2003 |
| JP | 2003-216100 | | 7/2003 |
| JP | 2003-255899 | | 9/2003 |
| JP | 2004-004501 | | 1/2004 |
| JP | 2005-049838 | | 2/2005 |
| KR | 2002-0080002 | | 10/2002 |
| WO | WO 96/24123 | | 8/1996 |
| WO | WO/0124153 | A1 | 4/2001 |
| WO | WO 03/077231 | * | 9/2003 |

OTHER PUBLICATIONS

Patent Abstracts of Japan, Publication No. 2003-122306, dated Apr. 25, 2003, in the name of Akira Yumoto.

EPO Search Report for Application No. 05103853.7, dated Sep. 6, 2005, in the name of Samsung SDI Co., Ltd.

Patent Abstracts of Japan, Publication No. 2002-244619, dated Aug. 30, 2002, in the name of Munenori Ono et al.

Patent Abstracts of Japan, Publication No. 2005-049838, dated Feb. 24, 2005, in the name of Dong-Yong Shin.

U.S. Office action dated Oct. 3, 2008, for related U.S. Appl. No. 11/128,924.

Patent Abstracts of Japan, Publication No. 62-187887, dated Aug. 17, 1987, in the name of Matsushita Electric Industrial Co., Ltd.

Patent Abstracts of Japan, Publication No. 03-085591, dated Apr. 10, 1991, in the name of Takashi Tsukada et al.

Patent Abstracts of Japan, Publication No. 04-355789, dated Dec. 9, 1992, in the name of Etsuji Ozaki.

Patent Abstracts of Japan, Publication No. 2000-347628, dated Dec. 15, 2000, in the name of Minoru Kanbara et al.

Patent Abstracts of Japan, Publication No. 2002-268615, dated Sep. 20, 2002, in the name of Hajimi Kimura.

Patent Abstracts of Japan, Publication No. 2003-022058, dated Jan. 24, 2003, in the name of Katsunori Yamazaki.

Patent Abstracts of Japan, Publication No. 2003-108070, dated Apr. 11, 2003, in the name of Koishi Yamada et al.

Patent Abstracts of Japan, Publication No. 2003-140619, dated May 16, 2003, in the name of Yoshinori Furubayashi et al.

Patent Abstracts of Japan, Publication No. 2003-216100, dated Jul. 30, 2003, in the name of Hiroshi Takahara.

Patent Abstracts of Japan, Publication No. 2003-255899, dated Sep. 10, 2003, in the name of Hiroshi Tsuchiya et al.

U.S. Office action dated Oct. 29, 2009, for related U.S. Appl. No. 11/245,324.

U.S. Office action dated Jan. 25, 2010, for related U.S. Appl. No. 11/132,097.

* cited by examiner

DISPLAY WITH MULTIPLE PIXELS SHARING A DATA LINE AND DRIVING METHOD THEREOF

CROSS REFERENCE TO RELATED APPLICATION

This application claims priority to and the benefit of Korean Patent Applications No. 10-2004-0037266 filed on May 25, 2004 and Nos. 10-2004-0038260 and 10-2004-0038261 respectively filed on May 28, 2004 in the Korean Intellectual Property Office, the entire contents of which are incorporated herein by reference.

BACKGROUND OF THE INVENTION (a) Field of the Invention

The present invention relates to a display and a driving method thereof.

(b) Description of the Related Art

In a display area of an active matrix display such as a liquid crystal display and an organic light emitting display, scan lines extended in a row direction and data lines extended in a column direction are formed. Two adjacent scan lines and two adjacent data lines define a pixel area, and a pixel is formed on the pixel area. An active element such as a transistor is formed on the pixel and transmits a data signal from the data line in response to a select signal from the scan line. Therefore, the active matrix display needs a scan driver for driving the scan lines and a data driver for driving the data lines.

In the active matrix display, colors are represented through combinations of colors emitted by certain pixels. In general, the pixels include pixels for displaying red, pixels for displaying green, and pixels for displaying blue, and the colors are displayed by combinations of red, green, and blue. In the display, the pixels are arranged in an order of red, green, and blue along a row direction, and data lines are respectively coupled to pixels arranged along the row direction.

Since a data driver converts the data signals to analog voltages or analog currents and applies those to all data lines, the data driver has many output terminals corresponding to the data lines. Generally, the data driver is manufactured in the form of an integrated circuit. However, a plurality of integrated circuits are used to drive all data lines since the number of output terminals which an individual integrated circuit has is limited. In addition, if the data line and driving elements are formed on each pixel, the aperture ratio corresponding to a light emission area of the pixel is reduced.

SUMMARY OF THE INVENTION

In an exemplary embodiment of the present invention, a display having a reduced number of the integrated circuits for driving data lines is provided.

In another exemplary embodiment of the present invention, a display having a reduced number of the data lines is provided.

In another exemplary embodiment of the present invention, two pixels share a data line and a scan line.

In one aspect of the present invention, a display includes a display area and a scan driver. The display area includes a plurality of data lines for transmitting data signals for displaying an image, a plurality of first scan lines for transmitting select signals, a plurality of second scan lines and a plurality of third scan lines for respectively transmitting emission control signals, and a plurality of pixel areas. A pixel area includes a first pixel and a second pixel coupled to the corresponding data line and the corresponding first scan line. The first pixel emits light in response to the second pulse and the second pixel emits light in response to the third pulse. The scan driver transmits first signals to the first scan lines by shifting the first signal, transmits second signals to the second scan lines by shifting the second signal, and transmits third signals to the third scan lines by shifting the third signal. The first signal has a first pulse in each of a plurality of subfields for forming a field, the second signal has a second pulse in a first subfield of the plurality of subfields, and the third signal has a third pulse in a second subfield of the plurality of subfields.

In another aspect of the present invention, a display device includes a plurality of first scan lines transmitting a plurality of first signals, a plurality of second scan lines transmitting a plurality of second signals, and a plurality of third scan lines transmitting a plurality of third signals. The display further includes a first driver, a second driver, and a third driver. The first driver outputs the first signals by shifting the first signal by a first period, the second driver outputs the second signals by shifting the second signal by the first period, and the third driver outputs the third signals by shifting the third signal by the first period. The first signal has a first pulse during a second period in each of a plurality of subfields forming a field, the second signal has a second pulse during a third period longer than the second period in a first subfield of the plurality of subfields, and the third signal has a third pulse during a fourth period longer than the second period in a second subfield of the plurality of subfields.

In still another aspect of the present invention, a display includes a plurality of first scan lines transmitting a plurality of first signals, a plurality of second scan lines transmitting a plurality of second signals, and a plurality of third scan lines transmitting a plurality of third signals. The display further includes a first driver and a second driver. The first driver outputs the first signals by shifting the first signal by a first period. The second driver generates the second signal and the third signal from a fourth signal. In addition, the second driver outputs the second signals by shifting the second signal by the first period, and outputs the third signals by shifting the third signal by the first period. The first signal has a first pulse during a second period in each of a plurality of subfields forming a field. The second signal has a second pulse during a third period longer than the second period in a first subfield of the plurality of subfields, and the third signal has a third pulse during a fourth period longer than the second period in a second subfield of the plurality of subfields from a fourth signal.

In a further aspect of the present invention, a scan driver outputs first signals by shifting the first signal by a first period, outputs second signals by shifting the second signal by the first period, and outputs third signals by shifting the first signal by the first period. The scan driver includes a first driver and a second driver. The first driver outputs fourth signals by shifting the fourth signal by the first period, and the fourth signal has a first pulse and a second pulse inverted to the first pulse in a field. The second driver generates the first signal having a third pulse during a second period in each of a plurality of subfields forming a field, the second signal having a fourth pulse during a third period longer than the second period in a first subfield of the plurality of subfields, and the third signal having a fifth pulse during a fourth period longer than the second period in a second subfield of the plurality of subfields, from a fourth signal.

In a still further aspect of the present invention, a display includes a first scan line, a second scan line, a third scan line, a data line transmitting a data signal for displaying an image, and a pixel area defined by the first, second, and third scan lines, and the data line. A driving method of the display includes outputting a select signal having a first pulse during a first period in each of a plurality of subfields forming a field, outputting a first emission control signal having a second pulse during a second period longer than the first period in a first subfield of the plurality of subfields, and outputting a second emission control signal having a third pulse during a third period longer than the first period in a second subfield of the plurality of subfields. The data signal is programmed to the pixel area in response to a pulse corresponding to the first pulse transmitted to the first scan line. A first pixel of the pixel area starts emitting light corresponding to the programmed data signal in response to a pulse corresponding to the second pulse transmitted to the second scan line, and a second pixel of the pixel area starts emitting light corresponding to the programmed data signal in response to a pulse corresponding to the third pulse transmitted to the third scan line.

DETAILED DESCRIPTION

Figure 1:
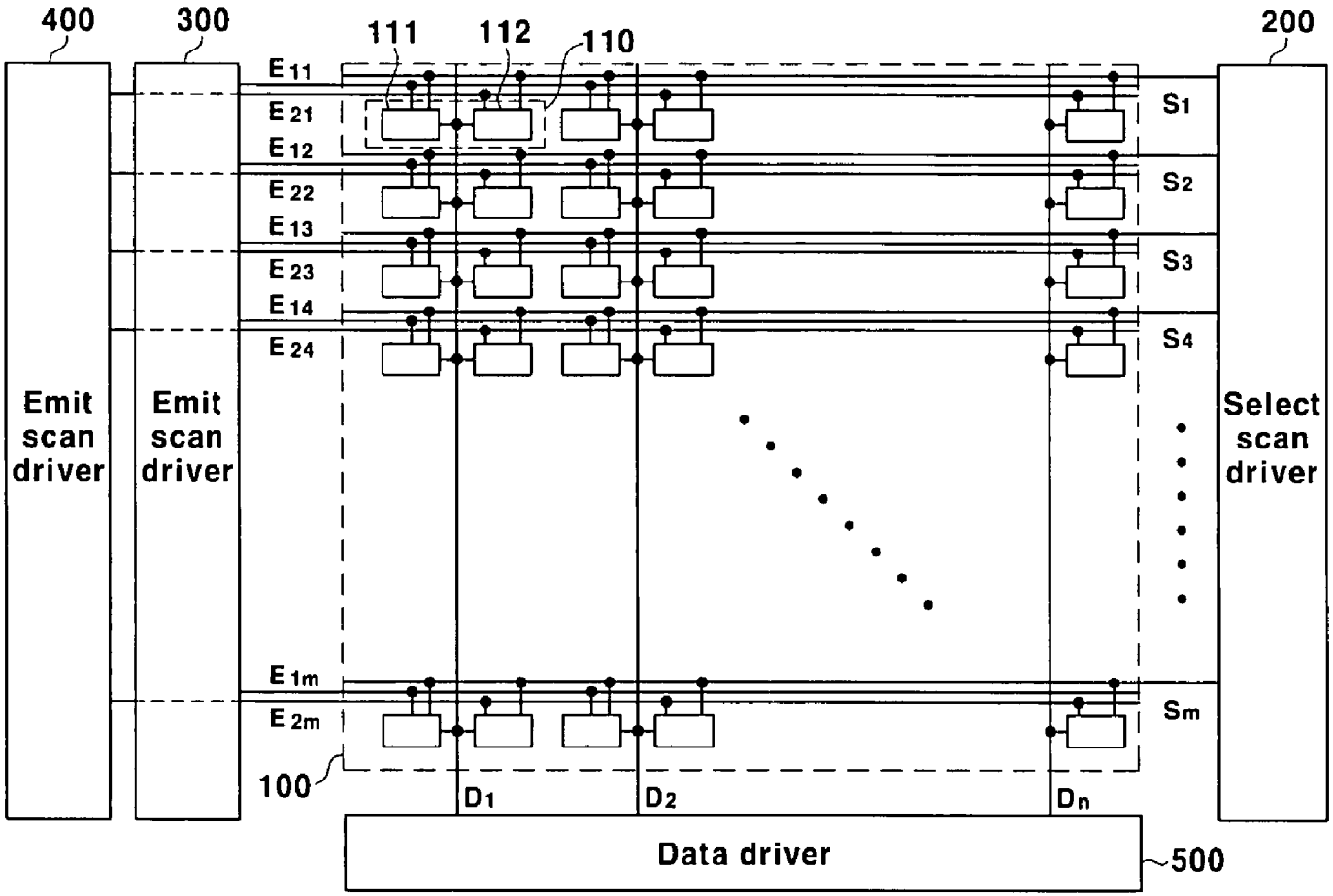
FIG. 1 shows a plan view of an organic light emitting display according to a first exemplary embodiment of the present invention.

Referring now to FIG. 1, an organic light emitting display includes a substrate (not shown) for forming a display panel, and the substrate is divided into a display area 100 seen as a screen to a user and a peripheral area surrounding the display area 100. The peripheral area includes a select scan driver 200, emit scan drivers 300, 400, and a data driver 500.

The display area 100 includes a plurality of data lines $D_1$ to $D_n$, a plurality of select scan lines $S_1$ to $S_m$, a plurality of emit scan lines $E_{11}$ to $E_{1m}$ and $E_{21}$ to $E_{2m}$, and a plurality of pixels. The data lines $D_1$ to $D_n$ are extended in a column direction and transmit data signals representing images to the corresponding pixels. The select scan lines $S_1$ to $S_m$ and the emit scan lines $E_{11}$ to $E_{1m}$ and $E_{21}$ to $E_{2m}$ are extended in a row direction and transmit select signals and emission control signals to the corresponding pixels, respectively. The pixel area 110 is defined by two adjacent scan lines $S_1$ to $S_m$ and two adjacent data lines $D_1$ to $D_m$, and two pixels 111, 112 are formed on the pixel area 110. That is, two pixels 111, 112 of the pixel area 110 are coupled to one of the data lines $D_1$ to $D_m$ and one of the select scan lines $S_1$ and $S_m$ in common.

The select scan driver 200 sequentially transmits select signals for selecting corresponding lines to the select scan lines $S_1$ to $S_m$ in order to apply data signals to pixels of the corresponding lines. The emit scan driver 300 sequentially transmits emission control signals for controlling light emission of pixels 111 to the emit scan lines $E_{11}$ to $E_{1m}$ in one subfield, and the emit scan driver 400 sequentially transmits emission control signals for controlling light emission of pixels 112 to the emit scan lines $E_{21}$ to $E_{2m}$ in the other subfield. The data driver 500 applies data signals corresponding to the pixels of lines to which select signals are applied to the data lines $D_1$ to $D_m$ each time the select signals are sequentially applied.

The select and emit scan drivers 200, 300, 400 and the data driver 500 are coupled to the substrate. In addition, the select and emit scan drivers 200, 300, and/or 400 and/or the data driver 500 can be installed directly on the substrate, and they can be substituted with a driving circuit which is formed on the same layer on the substrate as the layer on which scan lines, data lines, and transistors are formed. Further, the select and emit scan drivers 200, 300, and/or 400 and/or the data driver 500 can be installed in a chip format on a tape carrier package (TCP), a flexible printed circuit (FPC), or a tape automatic bonding unit (TAB) coupled to the substrate.

Figure 2:
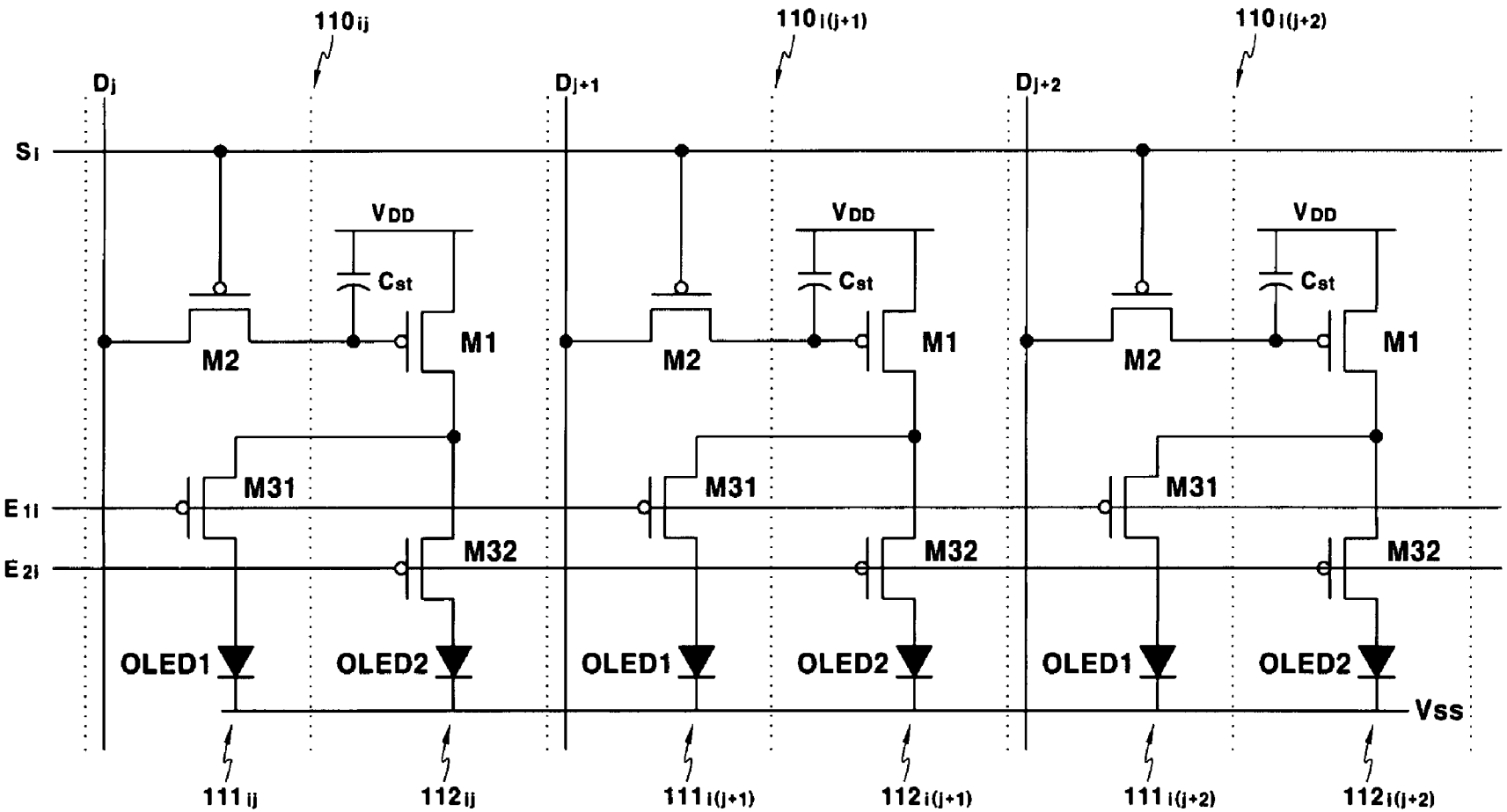
FIG. 2 shows a schematic diagram of pixel areas of the organic light emitting display according to the first exemplary embodiment of the present invention.

FIG. 2 shows a schematic diagram of the pixel areas of the organic light emitting display of FIG. 1. The three pixel areas $\mathbf{110}_{ij}$, $\mathbf{110}_{i(j+1)}$, $\mathbf{110}_{i(j+2)}$ coupled to the scan line $S_i$ of the $i^{th}$ row (where 'i' is an positive integer less than 'm') and the data lines $D_j$ to $D_{j+2}$ of the $j^{th}$ to $(j+2)^{th}$ columns (where 'j' is an positive integer less than 'n') will be exemplified in FIG. 2. It is assumed that the pixels are arranged in an order of red, green, and blue along the row direction in FIG. 2.

Referring to FIG. 2, the two pixels 111, 112 have one of the data lines $D_1$ to $D_n$ and a pixel driver in common, and the pixel driver includes a driving transistor M1, a switching transistor M2, and a capacitor Cst. The two pixels $\mathbf{111}_{ij}$, $\mathbf{111}_{ij}$ of the pixel area $\mathbf{110}_{ij}$ defined by the $i^{th}$ select scan line $S_i$ and the $j^{th}$ data line $D_j$ include the pixel driver, two emit transistors M31, M32, and two organic light emitting elements OLED1, OLED2. The organic light emitting elements OLED1, OLED2 emit light red and green lights, respectively. The organic light emitting elements emit light having a brightness corresponding to the applied current. The two pixels $\mathbf{111}_{i(j+1)}$, $\mathbf{112}_{i(j+1)}$ of the pixel area $\mathbf{110}_{i(j+1)}$ defined by the $i^{th}$ select scan line $S_i$ and the $(j+1)^{th}$ data line $D_{j+1}$, and the two pixels $\mathbf{111}_{i(j+2)}$, $\mathbf{112}_{i(j+2)}$ of the pixel area $\mathbf{110}_{i(j+2)}$ defined by the $i^{th}$ select scan line $S_i$ and the $(j+2)^{th}$ data line $D_{j+2}$ have the same structures as the pixels $\mathbf{111}_{ij}$, $\mathbf{112}_{ij}$. The organic light emitting elements OLED1, OLED2 of the two pixels $\mathbf{111}_{i(j+1)}$, $\mathbf{112}_{i(j+2)}$ emit light blue and red lights, respectively, and the organic light emitting elements OLED1, OLED2 of the two pixels $\mathbf{111}_{i(j+2)}$, $\mathbf{112}_{i(j+2)}$ emit light green and blue lights, respectively.

In more detail, the driving transistor M1 has a source coupled to the power line VDD for supplying a power supply voltage, and has a gate coupled to a drain of the switching transistor M2, and a capacitor Cst is coupled between a source and a gate of the driving transistor M1. The switching transistor M2 having a gate coupled to the select scan line $S_i$ and a source coupled to the data line $D_j$ transmits the data signal converted to analog voltage (hereinafter, "data voltage") provided by the data line $D_j$ in response to the select signal provided by the select scan line $S_i$. The driving transistor M1 has a drain coupled to sources of emit transistors M31, M32, and gates of the emit transistors M31, M32 are coupled to the emission control signal lines $E_{1i}$, $E_{2i}$, respectively. Drains of the emit transistors M31, M32 are coupled, respectively, to anodes of the organic light emitting elements OLED1, OLED2, and a power supply voltage VSS is applied to cathodes of the organic light emitting elements OLED1, OLED2. The power supply voltage VSS in the first exemplary embodiment can be a negative voltage or a ground voltage.

The switching transistor M2 transmits the data voltage provided by the data line $D_j$ to the gate of the driving transistor M1 in response to a low-level select signal provided by the select scan line $S_i$, and the voltage which corresponds to a difference between the data voltage transmitted to the gate of the transistor M1 and the power supply voltage VDD is stored in the capacitor Cst. When the emit transistor M31 is turned on in response to a low-level emission control signal provided by the emission control signal line $E_{1i}$, the current $I_{OLED}$, which corresponds to the voltage stored in the capacitor Cst as expressed in Equation 1 below, is transmitted to the organic light emitting element OLED1 from the driving transistor M1 to emit light. In a like manner, when the emitting transistor M32 is turned on in response to a low-level emission control signal provided by the emission control signal line $E_{2i}$, the current which corresponds to the voltage stored in the capacitor Cst is transmitted to the organic light emitting element OLED2 from the driving transistor M1 to emit light. Two emission control signals applied to the low emission control signal lines $E_{1i}$, $E_{2i}$ respectively have low-level periods without repetition during one field so that one pixel area can display two colors.

$$I_{OLED} = \frac{\beta}{2}(|V_{SG}| - |V_{TH}|)^2 \qquad \text{Equation 1}$$

where β is a constant determined by a channel width and a channel length of the transistor M1, $V_{SG}$ is a voltage between source and gate of the transistor M1, and $V_{TH}$ is a threshold voltage of the transistor M1.

Figure 3:
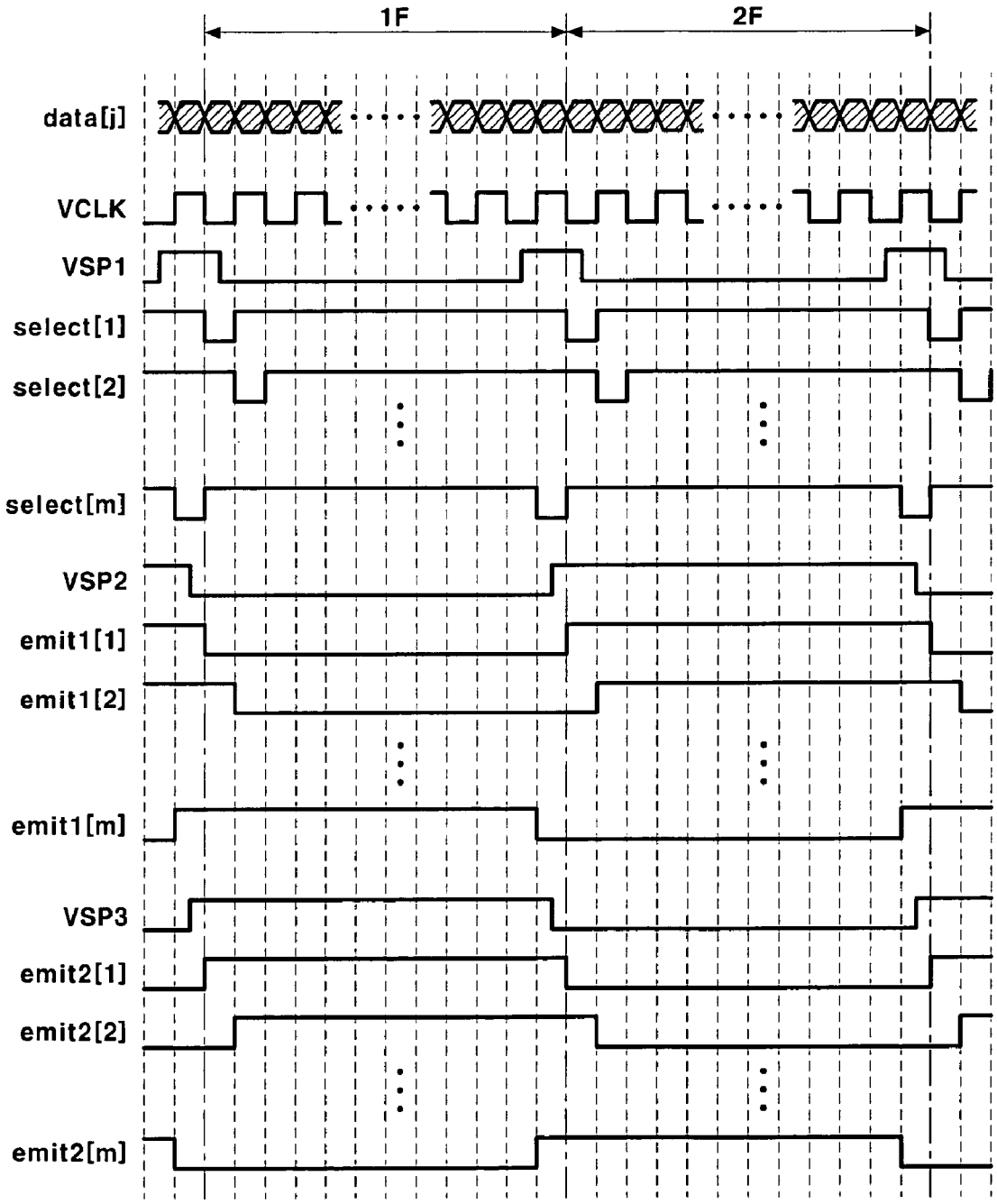
FIG. 3 shows a signal timing diagram of the organic light emitting display according to the first exemplary embodiment of the present invention.

A driving method of the organic light emitting display according to the first exemplary embodiment of the present invention will be described in more detail with reference to FIG. 3. In FIG. 3, the select signal applied to the select scan line $S_i$ is depicted as 'select[i]', and the emission control signals applied to the emit scan lines $E_{1i}$, $E_{2i}$ are depicted as 'emit1[i]', 'emit2[i]', respectively. The data voltage data[j] applied to the data line $D_j$ is depicted in FIG. 3 since the data voltages are simultaneously applied to the data lines $D_1$ to $D_n$.

Referring to FIG. 3, one field includes two subfields 1F, 2F, and the low-level select signals are sequentially applied to the select scan lines $S_1$ to $S_m$ in each subfield 1F or 2F. The two organic light emitting elements OLED1, OLED2 of the two pixels sharing the pixel driver emit light during periods corresponding to subfields SF1, SF2, respectively.

In the subfield 1F, when a low-level select signal select[1] is applied to the select scan line $S_1$ on the first row, a data voltage data[j] corresponding to the organic light emitting element OLED1 of the each pixel area on the first row is applied to the corresponding data line $D_j$, and a low-level emission control signal emit1[1] is applied to the emission control signal line $E_{1i}$ on the first row. The emit transistor M31 of the pixel area on the first row is turned on, and a current corresponding to the data voltage data[j] is transmitted to the organic light emitting element OLED1 from the driving transistor M1 to thus emit light. The light is emitted during the period in which the emission control signal emit1[1] is low-level, and the low-level period of the emission control signal emit1[1] is the same as the period which corresponds to the subfield 1F.

In a like manner, the data voltages are sequentially applied to pixel areas of from the first to $m^{th}$ rows to emit the organic light emitting element OLED1. When a low-level select signal select[i] is applied to the select scan line $S_i$ on the $i^{th}$ row, the data voltage data[j] corresponding to the organic light emitting element OLED1 of the each pixel area of the $i^{th}$ row are applied to the corresponding data line $D_j$, and a low-level emission control signal emit1[i] is applied to the emission control signal line $E_{1i}$ of the $i^{th}$ row. A current corresponding to the data voltage data[j] provided by each of the data lines $D_j$ is accordingly supplied to the organic light emitting element OLED1 of the corresponding pixel area on the $i^{th}$ row to thus emit light during the period which corresponds to the subfield 1F. Therefore, in the subfield 1F, the pixel on which the organic light emitting element OLED1 is formed emits light in the two pixels which are adjacent in the row direction.

In the subfield 2F, in a like manner as in the subfield 1F, a low-level select signal select[1] to select[m] is sequentially applied to the select scan lines $S_1$ to $S_m$ of from the first to the $m^{th}$ rows, and when the select signal select[i] is applied to the corresponding select scan line $S_i$, the data voltage data[j] corresponding to the organic light emitting element OLED2 of each pixel area of the corresponding rows are applied, respectively, to the corresponding data lines $D_j$. A low-level emission control signal emit2[i] is sequentially applied to the emission control signal line $E_{21}$ to $E_{2m}$ in synchronization with sequentially applying the low-level select signal select[i] to the select scan lines $S_1$ to $S_m$. A current corresponding to the applied data voltage is transmitted to the organic light emitting element OLED2 through the emitting transistor M32 in each pixel area to emit light. The low-level period of the emission control signal emit2[i] is the same as the period which corresponds to the subfield 2F. Therefore, in the subfield 2F, the pixel on which the organic light emitting element OLED2 is formed emits light in the two pixels which are adjacent in the row direction.

As described above, one field is divided into two subfields, and the subfields are sequentially driven in the organic light emitting display driving method according to the first exemplary embodiment. One organic light emitting element of two pixels of one pixel area in each subfield emits light, and the two organic light emitting elements sequentially emit light through two subfields to thus represent colors. In addition, the number of data lines and the number of pixel drivers can be reduced since the two pixels share the data line $D_j$ and the pixel driver. As a result, the number of integrated circuits for driving the data lines can be reduced, and the elements can be easily arranged in the pixel area.

Next, the select scan driver 200 and the emit scan drivers 300, 400 for generating the waveforms shown in FIG. 3 will be described with reference to FIGS. 4A to 6.

Figure 4A:
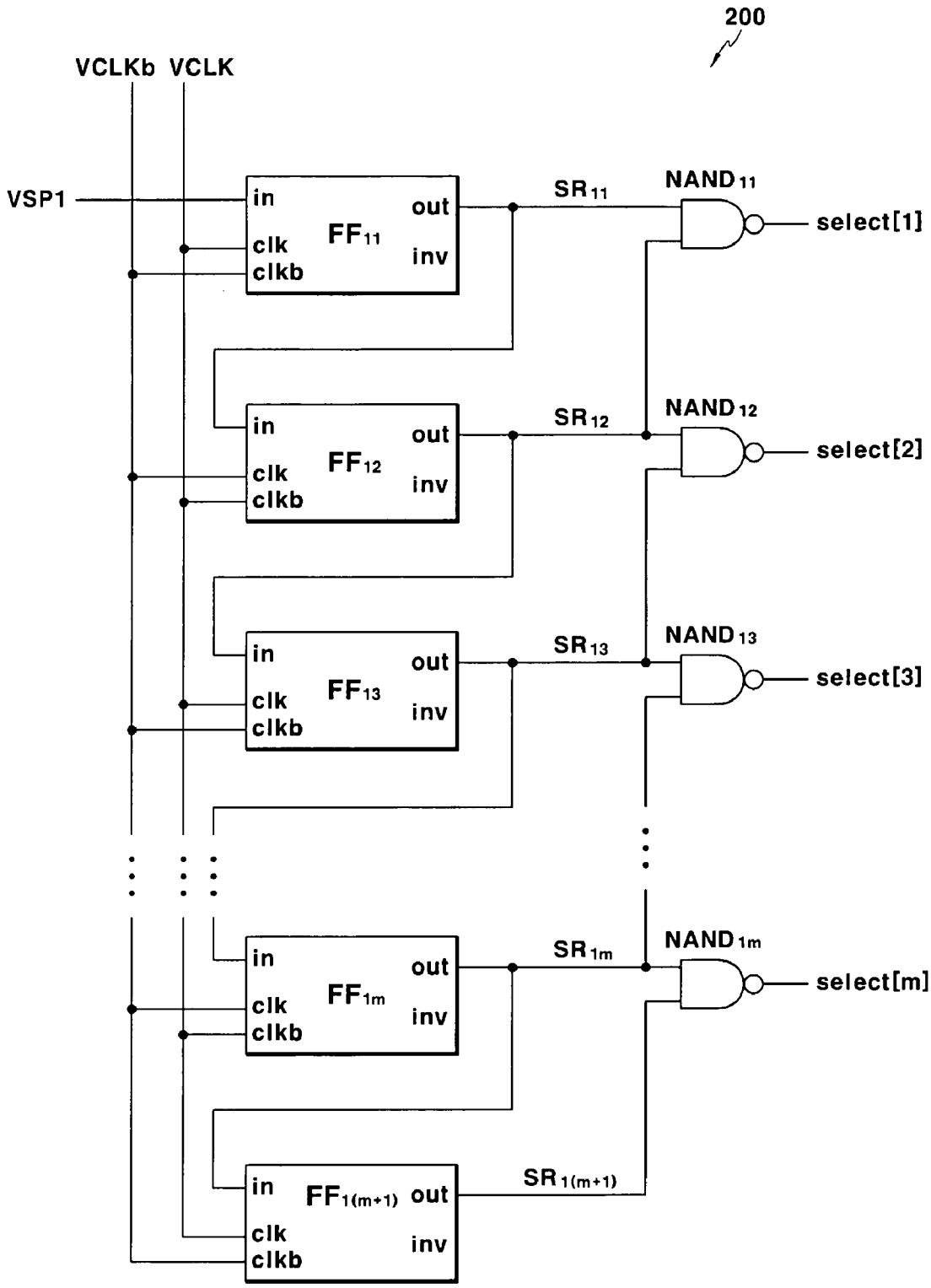
FIG. 4A shows a select scan driver in the organic light emitting display according to the first exemplary embodiment of the present invention.
Figure 4B:
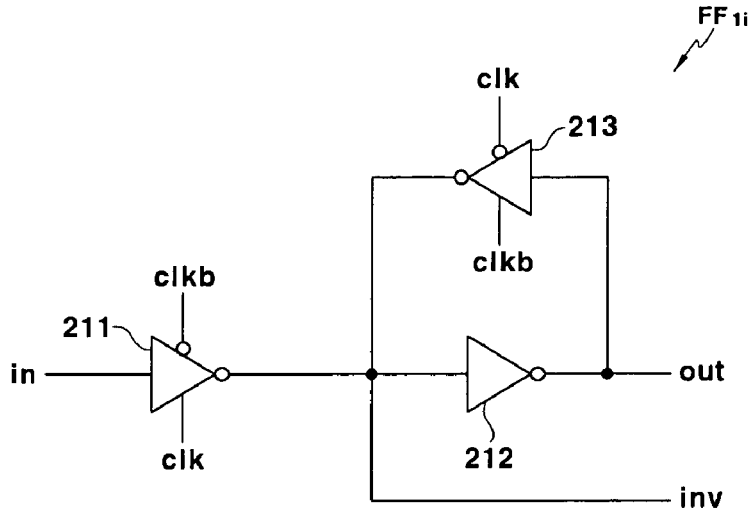
FIG. 4B shows a flip-flop used in the select scan driver of FIG. 4A.
Figure 5:
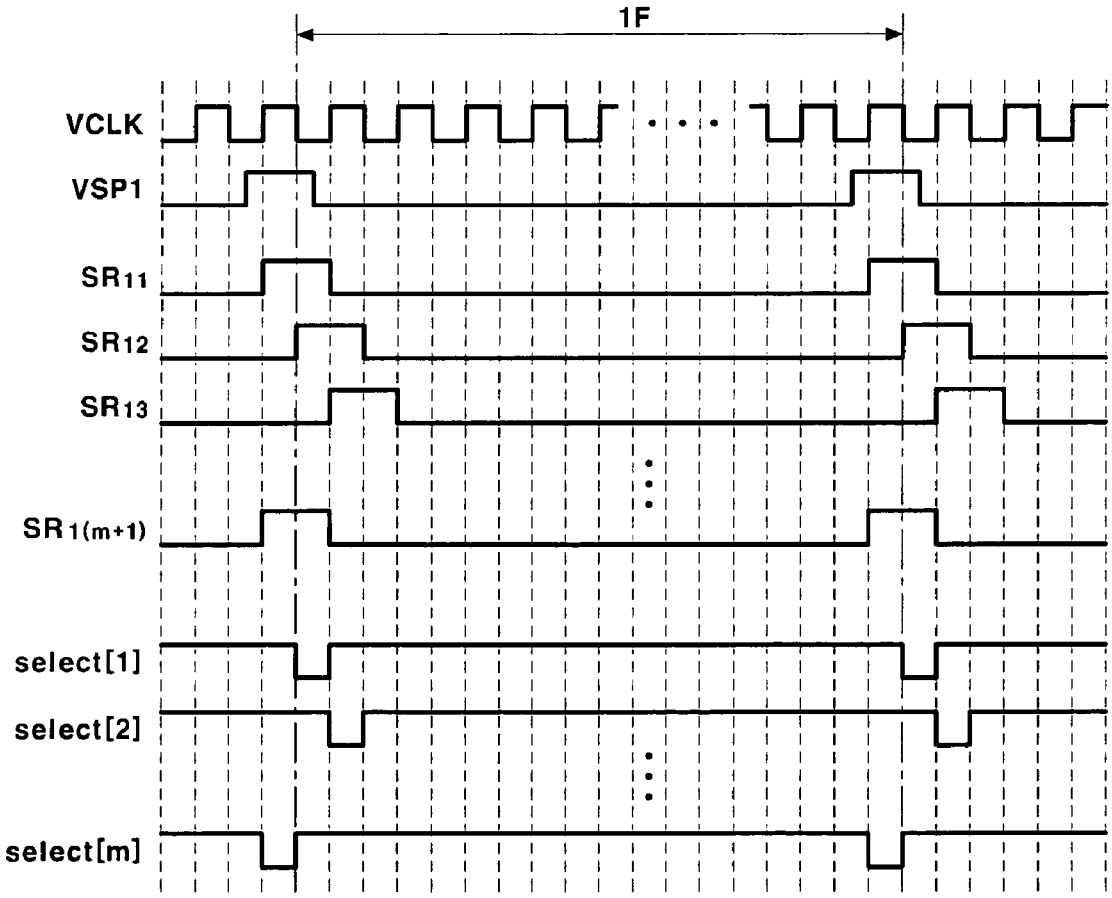
FIG. 5 shows a signal timing diagram in the select scan driver of FIG. 4A.

FIG. 4A shows the select scan driver 200 in the organic light emitting display according to the first exemplary embodiment. FIG. 4B shows a flip-flop used in the select scan driver 200 of FIG. 4A. FIG. 5 shows a signal timing diagram in the select scan driver 200 of FIG. 4A. An inverted signal of a clock VCLK is depicted as VCLKb in FIG. 4A, which is not shown in FIG. 5. The low-level period of one clock VCLK cycle is the same as the high-level period of one clock VCLK cycle.

Since structures of the scan drivers 200, 300, 400 are determined by pulse widths and pulse levels of the outputted signals, the conditions of the outputted signals of the scan drivers 200, 300, 400 are assumed to be as follows. The low-level pulse width of the select signal select[i] is the same as the half clock VCLK cycle in order to minimize the frequency of the clock VCLK; the number m of the select scan lines $S_1$ to $S_m$ is even, and the low-level pulse width of the emission control signal emit1[i] or emit2[i] corresponds to an integral multiple of 'm'; and a flip-flop used in the scan drivers 200, 300, 400 outputs a signal which is input during a half clock cycle during a one clock VCLK cycle. In these conditions, since the output pulse of the flip-flop is an integral multiple of one clock VCLK cycle, the output signal of the flip-flop may not be used as a select signal.

Therefore, the select scan driver 200 includes (m+1) flip-flops $FF_{11}$ to $FF_{1(m+1)}$ and m NAND gates $NAND_{11}$ to $NAND_{1m}$ as shown in FIG. 4A, and operates as a shift register. An output signal of the NAND gate $NAND_{1i}$ is the select signal select[i] (where 'i' is a positive integer of less than 'm'). The start signal VSP1 is input to the first flip-flop $FF_{11}$ in FIG. 4A, and the output signal $SR_{1i}$ of the $i^{th}$ flip-flop $FF_{1i}$ is input to the $(i+1)^{th}$ flip-flop $FF_{1(i+1)}$. The $i^{th}$ NAND gate $NAND_{1i}$ performs a NAND operation to the output signals $SR_{1i}$, $SR_{1(i+1)}$ of the two adjacent flip-flops $FF_{1i}$, $FF_{1(i+1)}$ and outputs the select signal select[i]. The clock VCLKb or VCLK inverted to the clock VCLK or VCLKb, which are used in the flip-flop $FF_{1i}$, are used in the flip-flops $FF_{1(i+1)}$ adjacent to the flip-flip $FF_{1i}$.

In more detail, the flip-flop $FF_{1i}$ which is located at the odd-numbered position in the longitudinal direction uses the clocks VCLK, VCLKb as inner clocks clk, clkb, respectively, and the flip-flop $FF_{1i}$ which is located at the even-numbered position in the longitudinal direction uses the clocks VCLKb, VCLK as inner clocks clk, clkb, respectively. In addition, the flip-flop $FF_{1i}$ outputs an input signal in response to the high-level clock clk, and latches and outputs the input signal of the high-level clock clk in response to the low-level clock clk. As a result, the output signal $SR_{1(i+1)}$ of the flip-flop $FF_{1(i+1)}$ is shifted from the output signal $SR_{1i}$ of the flip-flop $FF_{1i}$ by the half clock VCLK cycle.

As shown in FIG. 5, since the start signal VSP1 has a high-level pulse in the high-level period of the one clock VCLK cycle in the respective subfields 1F, 2F, the flip-flop $FF_{11}$ outputs the high-level pulse during one clock VCLK cycle in the respective subfields 1F, 2F. As a result, the flip-flops $FF_{11}$ to $FF_{1m}$ may sequentially output each output signal $SR_{1i}$ by shifting the high-level pulse by the half clock VCLK cycle.

The NAND gate $NAND_{1i}$ performs the NAND operation of the output signals $SR_{1i}$, $SR_{1(i+1)}$ of the flip-flops $FF_{1i}$, $FF_{1(i+1)}$, and outputs a low-level pulse when both output signals $SR_{11}$, $SR_{1(i+1)}$ are high-level. Here, since the output signal $SR_{1(i+1)}$ of the flip-flop $FF_{1(i+1)}$ is shifted from the output signal $SR_{1i}$ of the flip-flop $FF_{1i}$ by the half clock VCLK cycle, the output signal of the NAND gate $NAND_{1i}$ has a low-level pulse in a period, i.e., the half clock cycle during which the both output signals $SR_{1i}$, $SR_{1(i+1)}$ have the high-level pulse in common in the respective subfields 1F, 2F. In addition, the output signal select[i+1] of the NAND gate $NAND_{1(i+1)}$ is shifted from the output signal select[i] of the NAND gate $NAND_{1i}$ by half the clock VCLK cycle. Therefore, the select scan driver 200 may sequentially output each select signal select[i] by shifting the low-level pulse by the half clock VCLK cycle.

Referring to FIG. 4B, the flip-flop $FF_{1i}$ includes a clocked inverter 211, and an inverter 212 and a clocked inverter 213 for forming a latch. The clocked inverter 211 inverts an input signal (in) when the clock clk is high-level, and the inverter 212 inverts the output signal of the clocked inverter 211. When the clock clk is low-level, the output of the clocked inverter 211 is blocked, the output signal of the inverter 212 is input to the clocked inverter 213, and the output signal of the clocked inverter 213 is input to the inverter 212. As a result, the latch is formed. At this time, the output signal (out) of the inverter 212 is the output signal of the flip-flop $FF_{1i}$, and the input signal (inv) of the inverter 212 is the inverted signal to the output signal (out). Therefore, the flip-flop $FF_{1i}$ can output the input signal (in) when the clock (clk) is high-level, and latch and output the input signal (in) in the high-level period of the clock (clk) when the clock (clk) is low-level.

Figure 6:
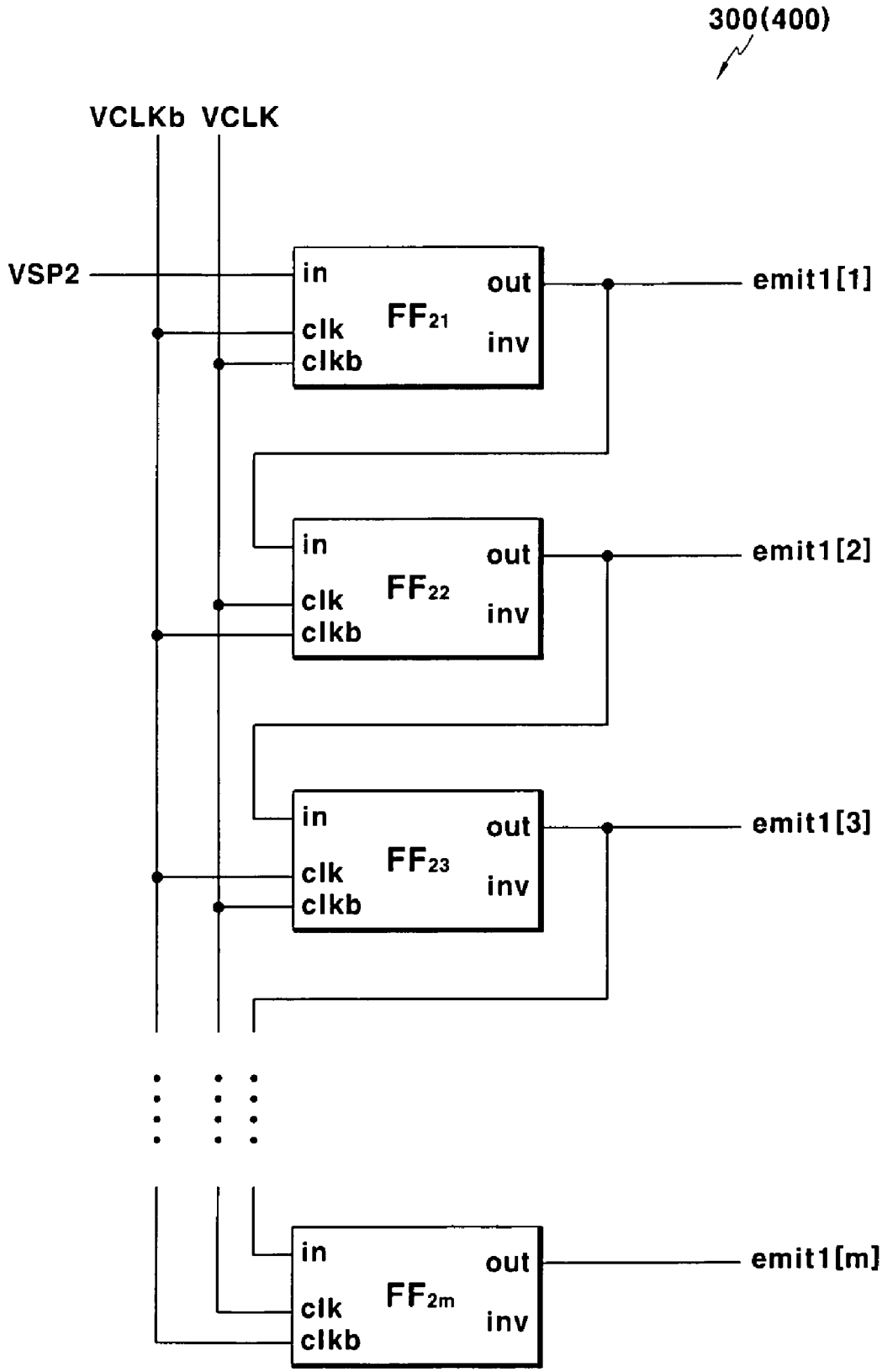
FIGS. 6, 9, and 11 show emit scan drivers in the organic light emitting displays according to second, third, and fourth exemplary embodiments of the present invention, respectively.

Next, the emit scan drivers 300, 400 for generating the waveforms of FIG. 3 will be described with reference to FIG. 6. FIG. 6 shows an emit scan driver 300 or 400 in the organic light emitting display according to the first exemplary embodiment.

Referring to FIG. 6, the emit scan driver 300 includes m flip-flops $FF_{21}$ to $FF_{2m}$, and operates as a shift register. The emit scan driver 300 use a clock the same as the clock VCLK of the select scan driver 200. A start signal VSP2 is input to the first flip-flop $FF_{21}$, and the output signal of the $i^{th}$ flip-flop $FF_{2i}$ is the emission control signal emit1[i] of the $i^{th}$ emission control signal line $E_{1i}$, and is input to the $(i+1)^{th}$ flip-flop $FF_{2(i+1)}$.

The clock VCLKb or VCLK inverted to the clock VCLK or VCLKb, which is used in the flip-flop $FF_{2i}$, are used in the flip-flops $FF_{2(i+1)}$ adjacent to the flip-flop $FF_{2i}$. In addition, a falling edge of a low-level pulse in the emission control signal emit1[1] of the first flip-flop $FF_{21}$ is shifted from a rising edge of a high-level pulse in the output signal $SR_{11}$ of the first flip-flop $FF_{11}$. Therefore, differently from FIG. 4A, the flip-flop $FF_{2i}$ which is located at the odd-numbered position in the longitudinal direction uses the clocks VCLKb, VCLK as inner clocks clk, clkb, respectively, and the flip-flop $FF_{2i}$ which is located at the even-numbered position in the longitudinal direction uses the clocks VCLK, VCLKb as inner clocks clk, clkb, respectively. Here, the flip-flop $FF_{2i}$ has the same structure as the flip-flop $FF_{1i}$ described in FIGS. 4A and 4B.

Since the start signal VSP2 has a low-level pulse in the low-level period of all clock VCLK cycles in the subfield 1F, the output signal emit1[1] of the flip-flop $FF_{21}$ has a low-level pulse in the subfield 1F. In addition, since the start signal VSP2 has a high-level pulse in the low-level period of all clock VCLK cycles in the subfield 2F, the output signal emit1[1] of the flip-flop $FF_{21}$ has a high-level pulse in the subfield 2F.

Therefore, the emit scan driver 300 can sequentially output each emission control signal emit1[i], which has the low-level pulse in a period which corresponds to the subfield 1F, by shifting the half clock VCLK cycle. Here, if the low-level period is shorter than the period which corresponds to the subfield 1F, the low-level period becomes shorter than the period which corresponds to the subfield 1F.

Since the emission control signal emit2[i] which is an output signal of the emit scan driver 400 is inverted to the emission control signal emit1[i] of the emit scan driver 300, the emit scan driver 400 may have the same structure as the emit scan driver 300. Here, if the subfield 1F has the same period as the subfield 2F, a signal, which is shifted from the start signal VSP2 by the period corresponding to the subfield 1F, may be used as a start signal of the emit scan driver 400. Then, the emit scan driver can sequentially output the each emission control signal emit2[i] by shifting the half clock VCLK cycle as shown in FIG. 3.

According to the select scan driver 200 and the emit scan drivers 300 and 400 as described above, the falling edge of the select signal select[i] in the respective subfields 1F, 2F corresponds to the falling edge of the respective emission control signals emit1[i], emit2[i] transmitted to the emission control signal lines $E_{1i}$, $E_{2i}$. The select signal select[i] and emission control signals emit1[i], emit2[i] may be used for the organic light emitting display using the voltage programming method. However, in the organic light emitting display using the current programming method, the current from the driving transistor M1 needs to be blocked from the organic light emitting elements OLED1, OLED2 when the corresponding data signal are programmed to the pixel. These exemplary embodiments will be described with reference to FIG. 7 to FIG. 12.

Figure 7:
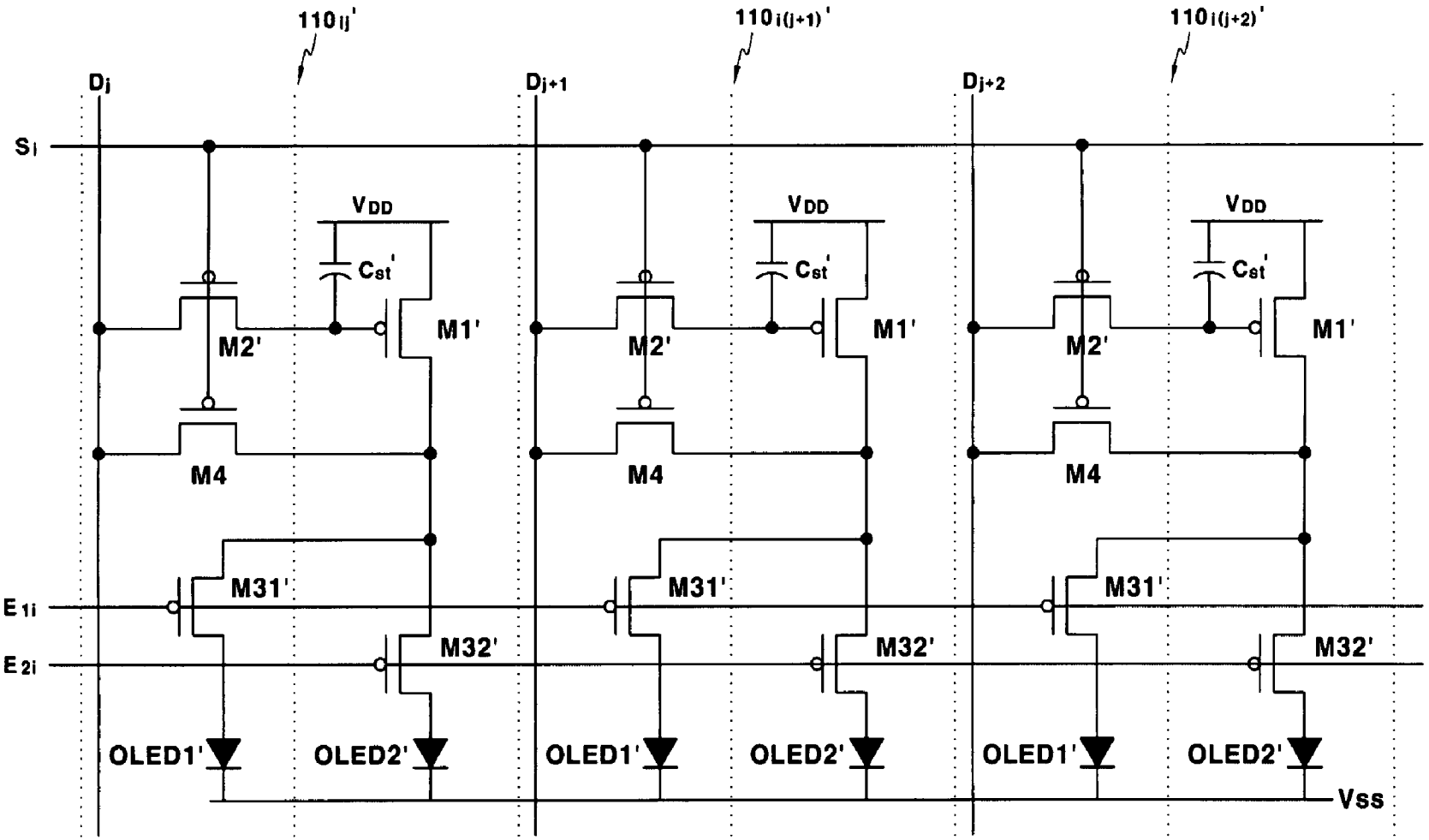
FIG. 7 shows a schematic diagram of pixel areas of the organic light emitting display according to the second exemplary embodiment of the present invention.

FIG. 7 shows a schematic diagram of the pixel areas of the organic light emitting display according to a second exemplary embodiment of the present invention. The organic light emitting display according to a second exemplary embodiment uses the current programming method in which the data signals converted to the analog currents (hereinafter, "data currents") are applied to the data lines $D_1$ to $D_n$.

As shown in FIG. 7, the pixel areas 110'$_{ij}$, 110'$_{i(j+1)}$, 110'$_{i(j+2)}$ according to the second exemplary embodiment have the same structure as that according to the first exemplary embodiment except for a pixel driver. In more detail, the pixel driver includes a driving transistor M1', a switching transistor M2', a diode-connecting transistor M4, and a capacitor Cst'. The connecting structure of the transistors M1', M2', M31', M32', the capacitor Cst', the select scan line $S_i$, the emit scan lines $E_{1i}$, $E_{2i}$, and the data line $D_j$ are the same as those described in FIG. 2. In addition, the transistor M4 is coupled between the drain of the transistor M1' and the data line $D_j$, and the gate of the transistor M4 is coupled to the select scan line $S_i$.

The transistors M2', M4 are turned on and the data current provided by the data line $D_j$ flows to the drain of the transistor M1' in response to a low-level select signal provided by the select scan line $S_i$. Then, the capacitor Cst' is charged until a current flowing to the drain of the transistor M1' by the voltage stored in the capacitor Cst' corresponds to the data current. That is, the voltage corresponding to the data current is stored in the capacitor Cst'.

When the emit transistor M31' is turned on in response to a low-level emission control signal emit1[i]' provided by the emission control signal line $E_{1i}$, the current $I_{OLED}$ which corresponds to the voltage stored in the capacitor Cst' is transmitted to the organic light emitting element OLED1' from the driving transistor M1' to emit light. In a like manner, when the emitting transistor M32' is turned on in response to a low-level emission control signal emit2[i]' provided by the emission control signal line $E_{2i}$, the current which corresponds to the voltage stored in the capacitor Cst' is transmitted to the organic light emitting element OLED2' from the driving transistor M1' to emit light.

Next, a driving method of the organic light emitting display according to the second exemplary embodiment of the present invention will be described in more detail with reference to FIG. 8.

Figure 8:
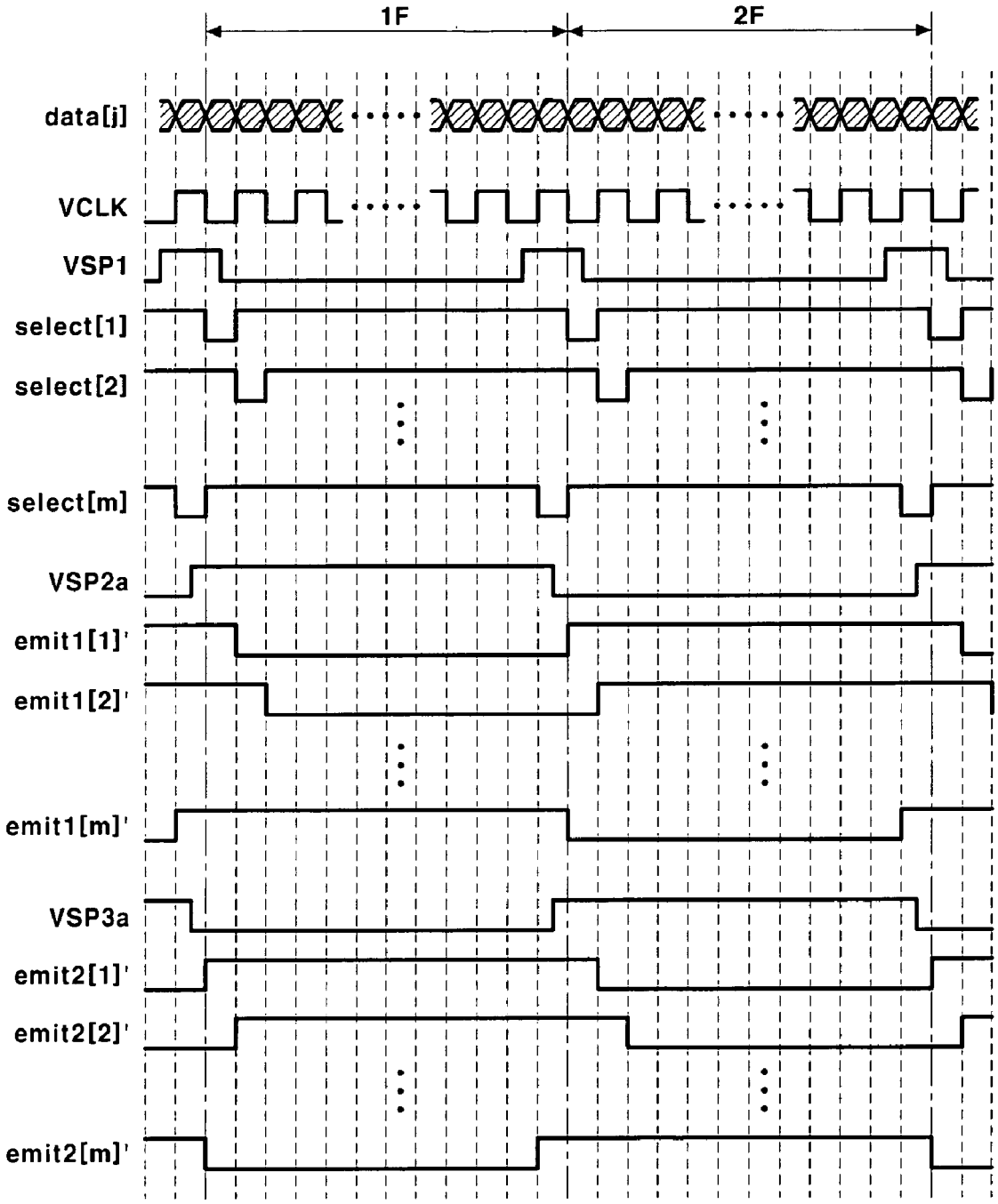
FIG. 8 shows a signal timing diagram of the organic light emitting display according to the second exemplary embodiment of the present invention.

Referring to FIG. 8, one field is divided into the two subfields 1F, 2F, and the driving method according to the second exemplary embodiment is the same as that according to the first exemplary embodiment except for the timing of the emission control signals emit1[i]', emit2[i]'.

In the subfield 1F, the emission control signal emit1[i]' transmitted to the $i^{th}$ emission control signal line $E_{1i}$ has the low-level pulse after the select signal select[i] transmitted to the $i^{th}$ select scan line $S_i$ rises to the high-level. In addition, the emission control signal emit1[i]' has the low-level pulse during a period which corresponds to a difference between the subfield 1F and the low-level pulse width of the select signal select[i].

Then, when a low-level select signal select[i] is applied to the select scan line $S_i$, the data current data[j]' corresponding to the organic light emitting element OLED1 of each pixel area on the $i^{th}$ row are applied to the corresponding data lines $D_j$. At this time, since the high-level emission control signals emit1[i]', emit2[i]' are applied to the emission control signal lines $E_{1i}$, $E_{2i}$ on the $i^{th}$ row, the organic light emitting elements OLED1', OLED2' are electrically interrupted from the driving transistor M1'. Therefore, the voltage corresponding to the data current data[j]' is stored in the capacitor Cst'. Next, a low-level emission control signal emit1[i]' is applied to the emission control signal line $E_{1i}$ on the first row. The emit transistor M31' of the pixel area on the $i^{th}$ row is turned on, and a current corresponding to the voltage stored in the capacitor Cst' is transmitted to the organic light emitting element OLED1 to thus emit light.

In a like manner, the low-level select signals select[1] to select[m] are sequentially applied to the select scan lines $S_1$ to $S_m$ of from the first to the $m^{th}$ rows. When the select signal select[i] of the select scan line $S_i$ rises to the high-level, the low-level emission control signal emit1[i]' is applied to the emit scan line $E_{1i}$ on the $i^{th}$ row.

In the subfield 2F, in a like manner as the subfield 1F, the emission control signal emit2[i]' transmitted to the $i^{th}$ emission control signal line $E_{2i}$ has the low-level pulse after the select signal select[i] transmitted to the $i^{th}$ select scan line $S_i$ rises to the high-level. In addition, the emission control signal emit1[i]' has the low-level pulse during a period which corresponds to a difference between the subfield 2F and the low-level pulse width of the select signal select[i].

Next, emit scan drivers 300*a*, 400*a* for generating the waveforms shown in FIG. 8 will be described with reference to FIGS. 9 to 12.

Figure 9:
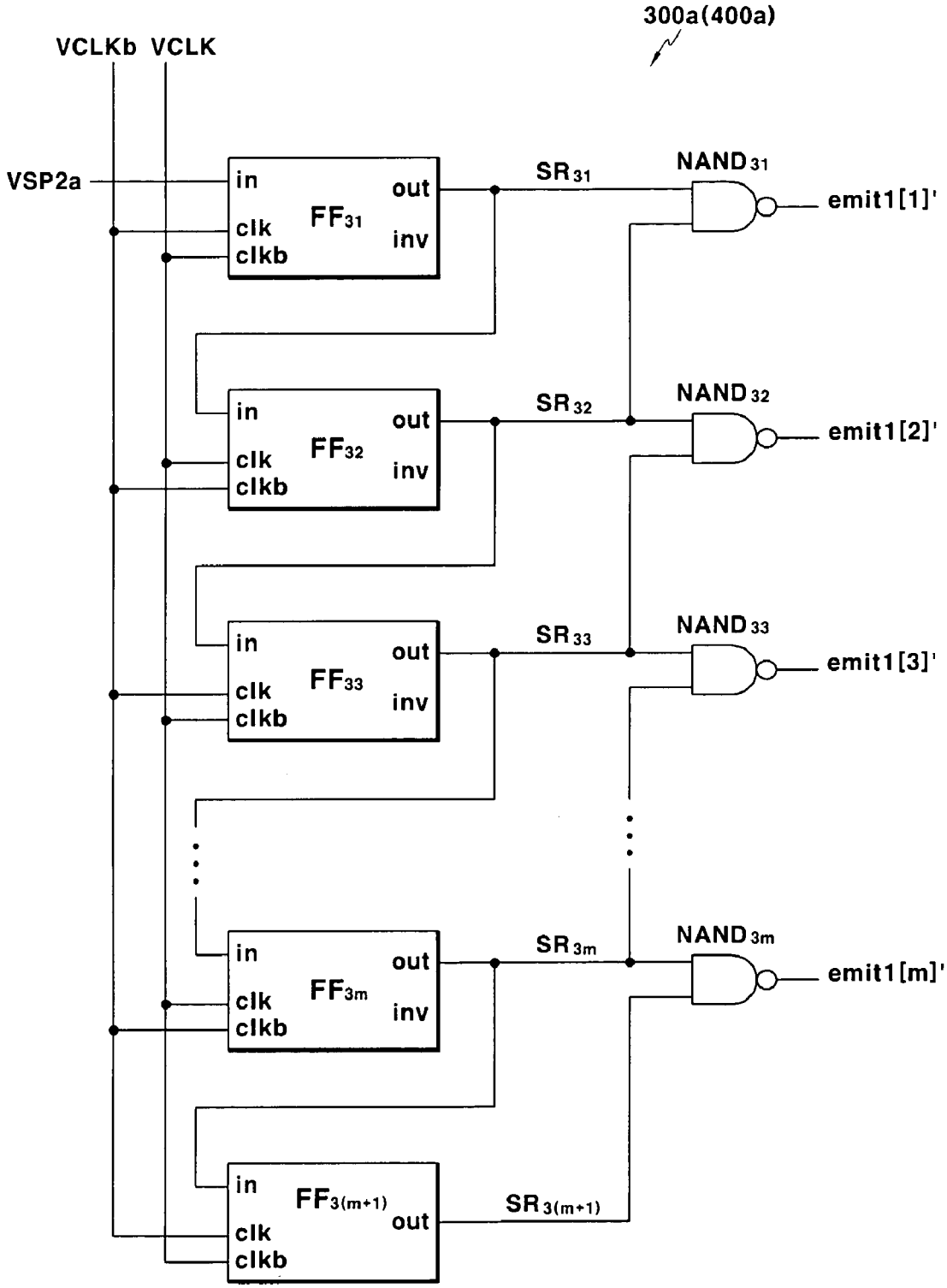
Figure 10:
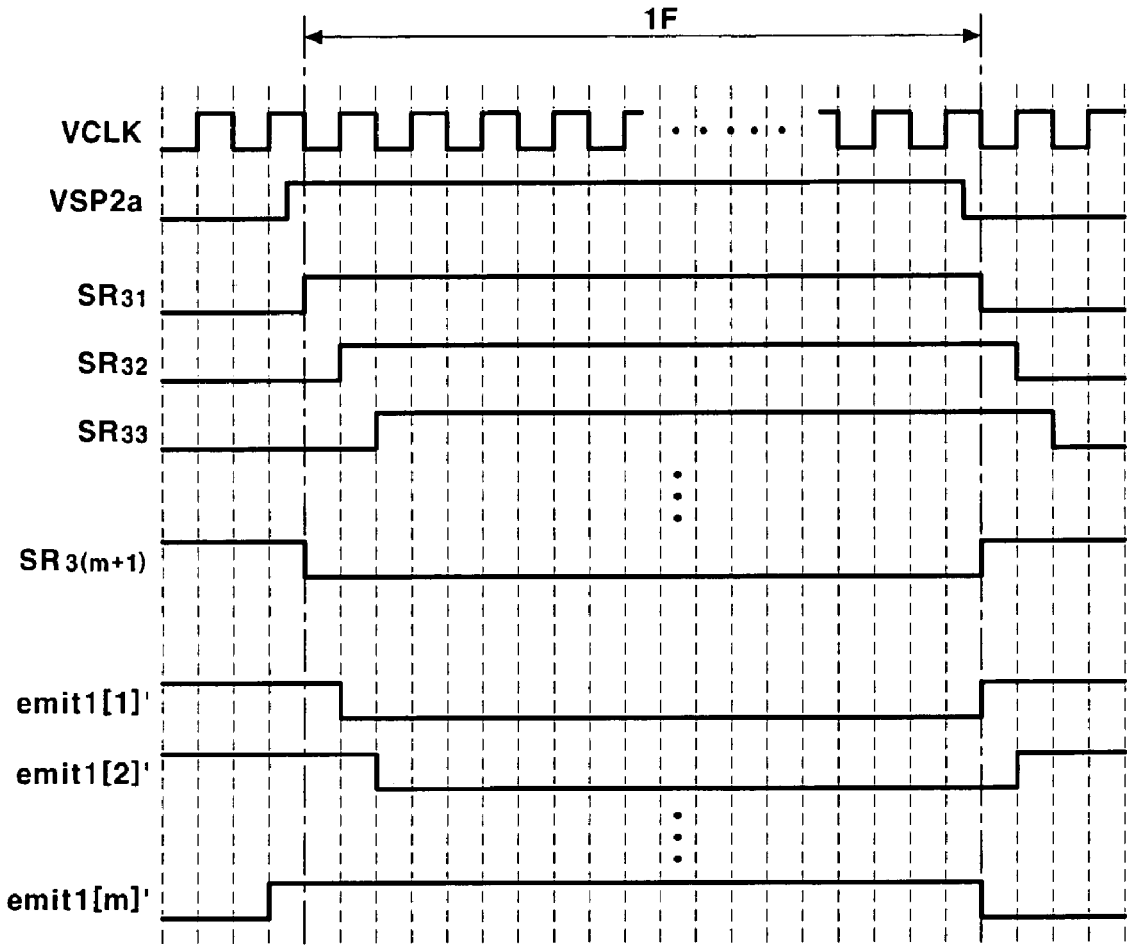
FIGS. 10 and 12 show signal timing diagrams in the emit scan drivers of FIGS. 9 and 11, respectively.

FIG. 9 shows the emit scan driver 300*a* in the organic light emitting display according to the second exemplary embodiment, and FIG. 10 shows a signal timing diagram of the emit scan driver 300*a* shown in FIG. 9. As shown in FIGS. 3 and 8, since the timing of the select signal select[i] in the organic light emitting display according to the second exemplary embodiment is the same as that according to the first exemplary embodiment, the select scan driver 200 shown in FIGS. 4A and 4B may be used as the select scan driver according to the second exemplary embodiment.

In the second exemplary embodiment, since the emission control signal emit1[i]' is the high-level when the select signal select[i] is the low-level, the low-level pulse width of the emission control signal emit1[i]' becomes an odd multiple of the half clock cycle. However, since the output signal of the emit scan driver 300 shown in FIG. 6 is an integral multiple of the one clock cycle, the emit scan driver 300 shown in FIG. 6 may not be applicable to the signal timing diagram shown in FIG. 8.

Therefore, as shown in FIG. 9, the emit scan driver 300*a* according to the second exemplary embodiment includes (m+1) flip-flops $FF_{31}$ to $FF_{3(m+1)}$ and m NAND gates $NAND_{31}$ to $NAND_{3m}$, and operates as a shift register. A start pulse VSP2*a* shown in FIGS. 8 and 10 is input to first flip-flop $FF_{31}$, and an output signal $SR_{3i}$ of $i^{th}$ the flip-flop $FF_{3i}$ is input to the $(i+1)^{th}$ flip-flop $FF_{3(i+1)}$ (where 'i' is an positive integer less that 'm'). The NAND gate $NAND_{3i}$ performs NAND operation between the output signals $SR_{3i}$, $SR_{3(i+1)}$ of the two flip-flops $FF_{3i}$, $FF_{3(i+1)}$, and outputs the emission control signal emit1[i]'.

Here, the emit scan driver 300*a* has the same structure as that shown in FIG. 4A except for the clocks VCLK, VCLKb. That is, the flip-flop $FF_{3i}$ which is located at the odd number of position in the longitudinal direction uses the clocks VCLKb, VCLK as inner clocks clk, clkb, respectively, and the flip-flop $FF_{3i}$ which is located at the even number of position uses the clocks VCLK, VCLKb as inner clocks clk, clkb, respectively. Then, the falling edge of the low-level pulse in the emission control signal emit1[i]' can be shifted by the half clock VCLK cycle from the falling edge of the low-level pulse in the select signal select[i].

The first flip-flop $FF_{31}$ receives the start signal VSP2*a* when the clock VCLK is the low-level, and outputs the received signal during the one clock VCLK cycle. Referring to FIG. 10, the start signal VSP2*a* has the high-level pulse in the low-level period of all clock VCLK cycles in the subfield 1F, and has the low-level pulse in the low-level period of all clock VCLK cycles in the subfield 2F. Therefore, the flip-flops $FF_{31}$ to $FF_{3(m+1)}$ may sequentially output the output signals, which respectively have the high-level pulses in a period which corresponds to the subfield 1F, by shifting the half clock VCLK cycle.

The NAND gate $NAND_{3i}$ performs NAND operation between the output signals $SR_{3i}$, $SR_{3(i+1)}$ of the flip-flops $FF_{3i}$, $FF_{3(i+1)}$, and outputs the low-level pulse while the both output signals $SR_{3i}$, $SR_{3(i+1)}$ are the high-level. Therefore, the output signal of the NAND gate $NAND_{3i}$, i.e. the emission control signal emit1[i]' has the low-level pulse during a period which corresponds to a difference the subfield 1F and the half clock VCLK cycle. The falling edge of the emission control signal emit1[i]' corresponds to the rising edge of the select signal select[i]. In addition, as shown in FIGS. 4A and 5, the emission control signal emit1[i+1]' which is the output signal of the NAND gate $NAND_{3(i+1)}$ is shifted by the half clock VCLK cycle from the emission control signal emit1[i]' which is the output signal of the NAND gate $NAND_{3i}$.

Since the emission control signal emit2[i]' in the subfield 2F has the waveform shifted from the emission control signal emit1[i]', the emit scan driver 300*a* may be applicable to the emit scan driver 400*a*. Here, if the period corresponding to the subfield 1F is the same as the period corresponding to the subfield 2F, a signal shifted by the subfield 1F from the start signal VSP2*a* can be used as a start signal VSP3*a* of the emit scan driver 400*a*.

As described above, the emit scan drivers 300*a*, 400*a* have the same structure as the select scan driver 200 shown in FIGS. 4A and 4B, but further embodiments may have a different structure from that of select scan driver 200. These further embodiments will be described in more detail with reference to FIGS. 11 and 12.

Figure 11:
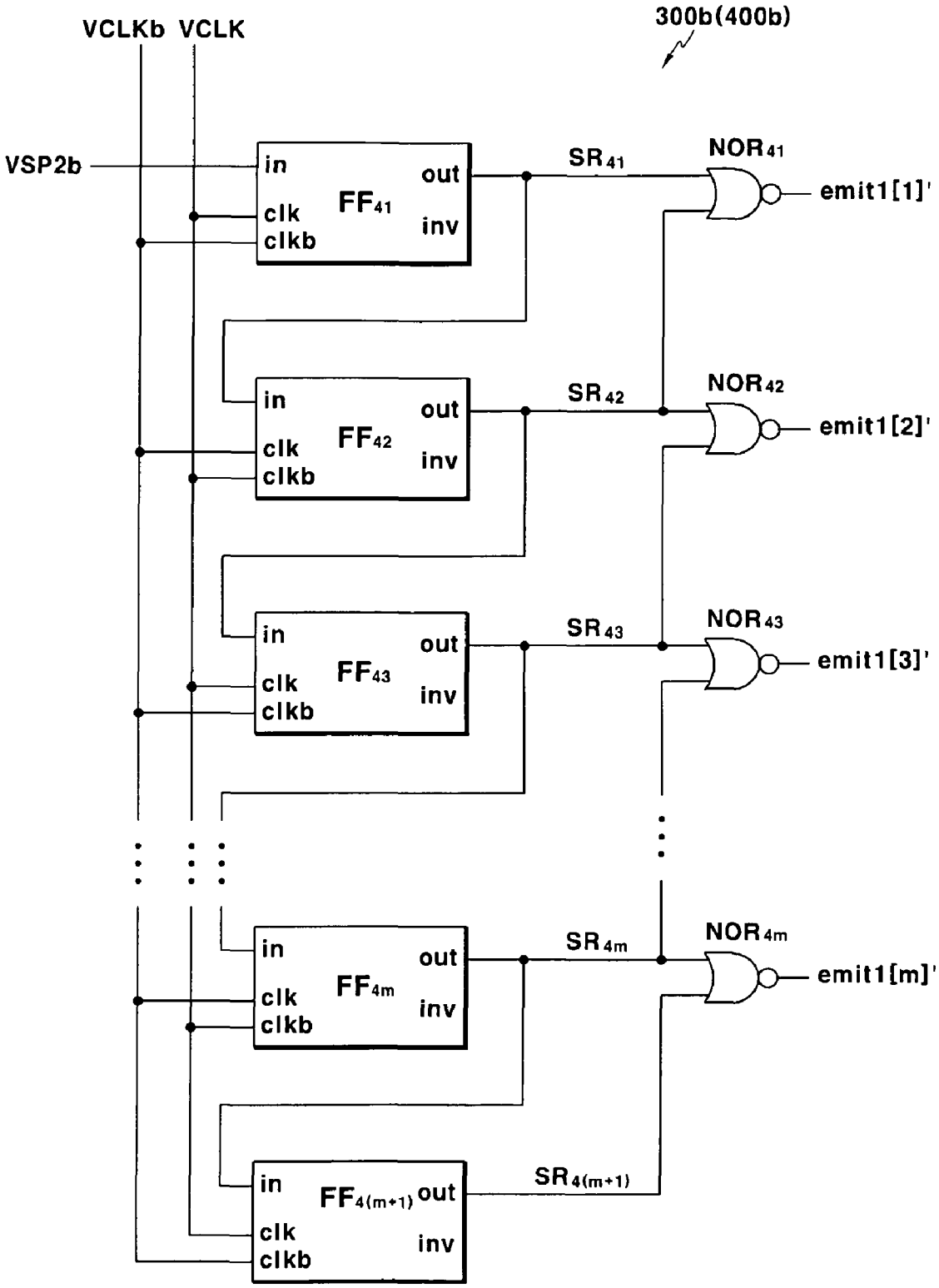
Figure 12:
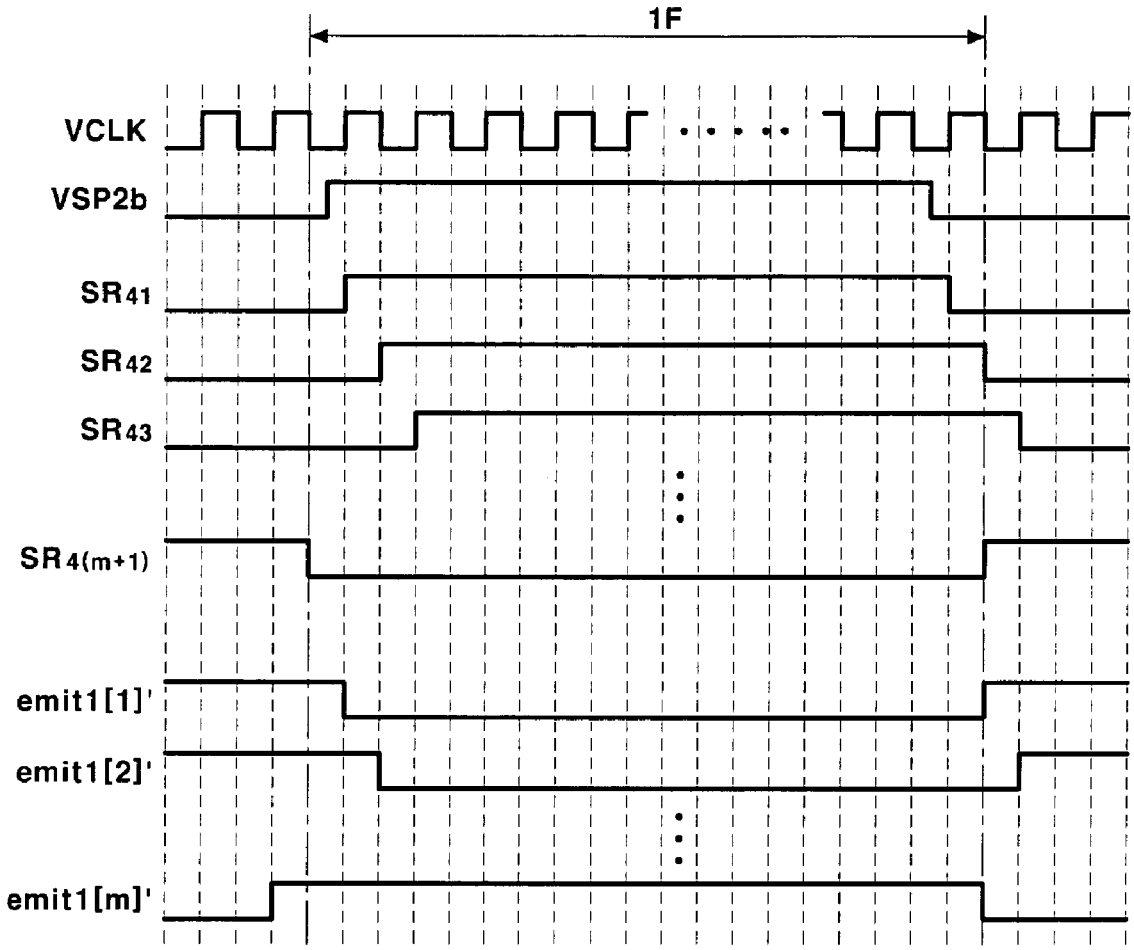

FIG. 11 shows an emit scan driver 300*b* in an organic light emitting display according to a third exemplary embodiment, and FIG. 12 shows a signal timing diagram of the emit scan driver 300*b* shown in FIG. 11.

As shown in FIG. 11, the emit scan driver 300*b* according to the third exemplary embodiment includes (m+1) flip-flops $FF_{41}$ to $FF_{4(m+1)}$ and m NOR gates $NOR_{41}$ to $NOR_{4m}$, and operates as a shift register. An output signal of the NOR gate $NOR_{41}$ is the emission control signal emit[1]' transmitted to the emit scan line $E_{1i}$. A start pulse VSP2*b* shown in FIG. 12 is input to first flip-flop $FF_{41}$, and an output signal $SR_{4i}$ of $i^{th}$ the flip-flop $FF_{4i}$ is input to the $(i+1)^{th}$ flip-flop $FF_{4(i+1)}$ (where 'i' is an positive integer less that 'm'). The NOR gate $NOR_{4i}$ performs a NOR operation between the output signals $SR_{4i}$, $SR_{4(i+1)}$ of the two flip-flops $FF_{4i}$, $FF_{4(i+1)}$, and outputs the emission control signal emit1[i]'.

In the third embodiment, the emission control signal emit1[i]' is generated by a NOR operation. For the NOR operation, the output signal $SR_{4i}$ of the flip-flop $FF_{4i}$ is shifted by the half clock VCLK cycle from the output signal $SR_{3i}$ of the flip-flop $FF_{3i}$. Therefore, the flip-flop $FF_{4i}$ uses the clock VCLK or VCLKb inverted to the clock VCLKb or VCLK of the flip-flop $FF_{3i}$ shown in FIG. 9, and the first flip-flop $FF_{41}$ receives the start signal VSP2*b* when the clock VCLK is the high-level and outputs the received signal during the one clock VCLK cycle. As shown in FIG. 12, since the start pulse VSP2*b* has the high-level pulse in the high-level period of all clock VCLK cycles during a period which corresponds to a difference between the subfield 1F and the one clock VCLK cycle, the output signal $SR_{41}$ of the flip-flop $FF_{41}$ has the high-level pulse during this period. In addition, since the start signal VSP2*b* is the low-level in the subfield 2F, the output signal $SR_{41}$ is the low-level in the subfield 2F. Accordingly, the flip-flops $FF_{41}$ to $FF_{4(m+1)}$ may sequentially output the output signals $SR_{41}$ to $SR_{4(m+1)}$ by shifting the high-level pulse by the half clock VCLK cycle, and the respective output signals $SR_{41}$ to $SR_{4(m+1)}$ have the high-level pulse in the period which corresponds to the difference between the subfield 1F and the one clock VCLK cycle.

NOR gate $NOR_{4i}$ outputs the low-level pulse while at least one of the output signals $SR_{4i}$, $SR_{4(i+1)}$ of the flip-flops $FF_{4i}$, $FF_{4(i+1)}$ is the high-level. Therefore, the output signal emit1[i]' has the low-level pulse in a period which corresponds to a difference between the subfield and the half clock VCLK cycle, and the falling edge of the low-level pulse corresponds to the rising edge of the select signal select[i]. In addition, the output signal emit1[i+1]' is shifted from the emission control signal emit1[i]' by the half clock VCLK cycle since the output signal $SR_{4(i+1)}$ is shifted from the output signal $SR_{4i}$ by the half clock VCLK cycle.

Since the emission control signal emit2[i]' in the subfield 2F has the waveform shifted from the emission control signal emit1[i]', the emit scan driver 300*b* may be applicable to the emit scan driver 400*b*. Here, if the period corresponding to the subfield 1F is the same as the period corresponding to the subfield 2F, a signal shifted by the subfield 1F from the start signal VSP2*b* can be used as a start signal of the emit scan driver 400*b*.

As described above, the emit scan driver used in the organic light emitting display of the current programming method may be applicable to that of the voltage programming method. That is, the emit scan driver according to the second and third exemplary embodiments may be applicable to the organic light emitting display in which the organic light emitting elements doesn't emit light in the low-level period of the select signal.

Figure 13:
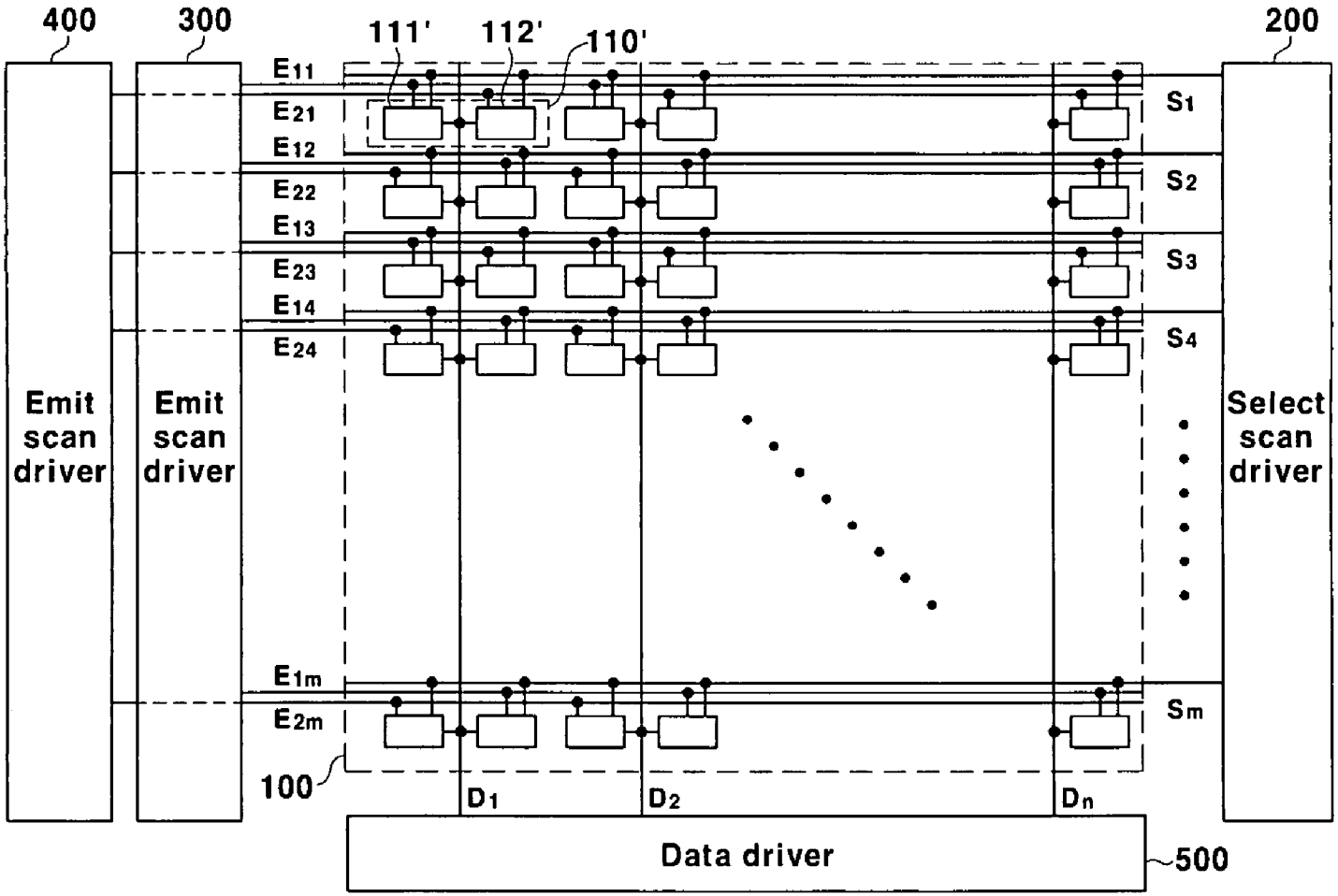
FIGS. 13 and 14 show plan views of organic light emitting displays according to fourth and fifth exemplary embodiments of the present invention, respectively.

In addition, the select and emit scan drivers according to the first to third exemplary embodiment may be applicable to an organic light emitting display shown in FIG. 13. FIG. 13 shows a plan view of the organic light emitting display according to a fourth exemplary embodiment of the present invention.

Referring to FIG. 13, a connection between the emit scan lines $E_{1i}$, $E_{2i}$ on the $i^{th}$ row and the pixel area 110' is different from a connection between the emit scan lines $E_{1(i+1)}$, $E_{2(i+1)}$ on the $(i+1)^{th}$ row and the pixel area 110'. In more detail, if the emit scan line $E_{1i}$ is coupled to the left pixels 111' of the pixel areas 110' on the $i^{th}$ row (where 'i' is an odd integer less than 'm') and the emit scan line $E_{2i}$ is coupled to the right pixels 112' of the pixel areas 110' on the $i^{th}$ row, the emit scan line $E_{1(i+1)}$ is coupled to the right pixels 112' of the pixel areas 110' on the $(i+1)^{th}$ row and the emit scan line $E_{2(i+1)}$ is coupled to the left pixels 112' of the pixel areas 110' on the $(i+1)^{th}$ row. Then, the left pixels 111' of the pixel areas 110' on the odd row and the right pixels 112' of the pixel areas 110' on the even row emit light in the subfield 1F, and the right pixels 112' of the pixel areas 110' on the odd row and the left pixels 111' of the pixel areas 110' on the even row emit light in the subfield 2F.

Next, exemplary embodiments which form the emit scan drivers 300, 400 as one emit scan driver will be described with reference to FIGS. 14 to 21.

Figure 14:
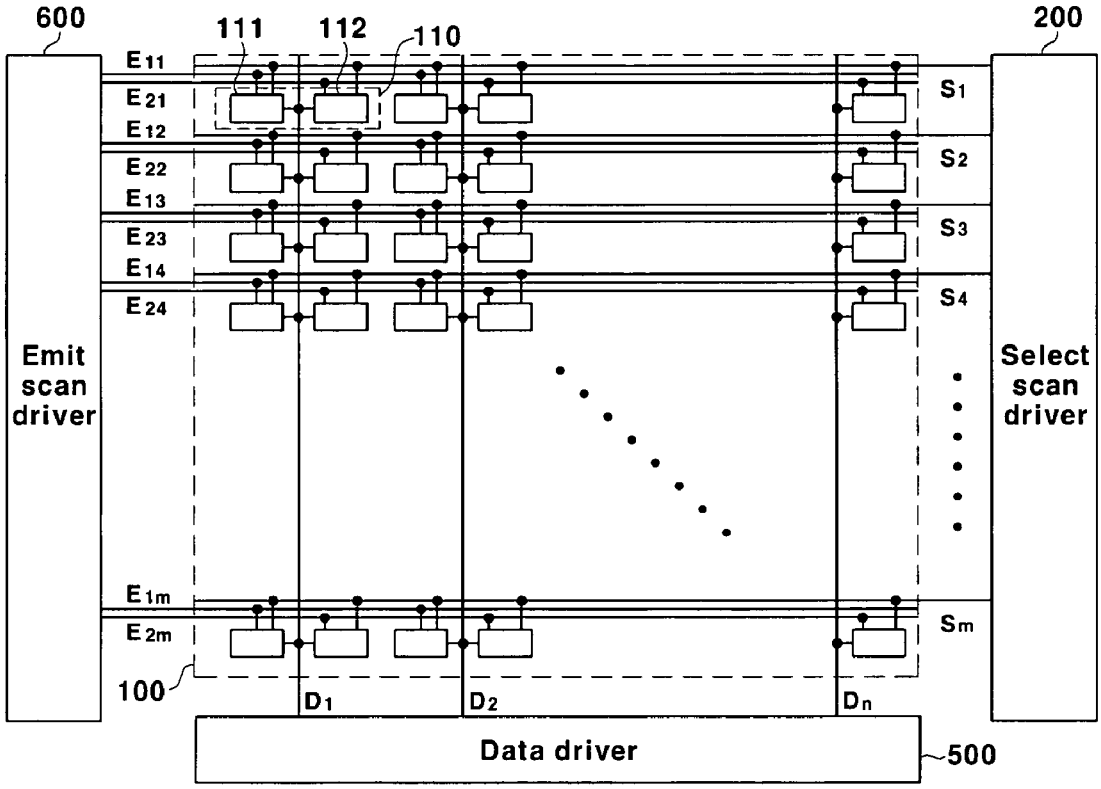

FIG. 14 shows a plan view of an organic light emitting display according to a fifth exemplary embodiment of the present invention. The organic light emitting display according to the fifth exemplary embodiment has the same structure as that shown in FIG. 1 except for an emit scan driver 600 in place of emit scan drivers 300, 400. The emit scan driver 600 sequentially transmits emission control signals emit1[1] to emit1[m] for controlling light emission of pixels 111 to the emit scan lines $E_{11}$ to $E_{1m}$ in the subfield 1F, and sequentially transmits emission control signals emit2[1] to emit2[m] for controlling light emission of pixels 112 to the emit scan lines $E_{21}$ to $E_{2m}$ in the subfield 2F.

The emit scan driver 600 for generating the signal timing shown in FIG. 3 will be described with reference to FIG. 15.

As shown in FIG. 3, since the emission control signal emit2[i] is inverted to the emission control signal emit1[i], the emit scan driver 600 may output one, for example emit1[i], of the emission control signals emit1[i], emit2[i] as does the emit scan driver 300 shown in FIG. 6, and invert the emission control signal emit1[i] to output the emission control signal emit2[i].

Figure 15:
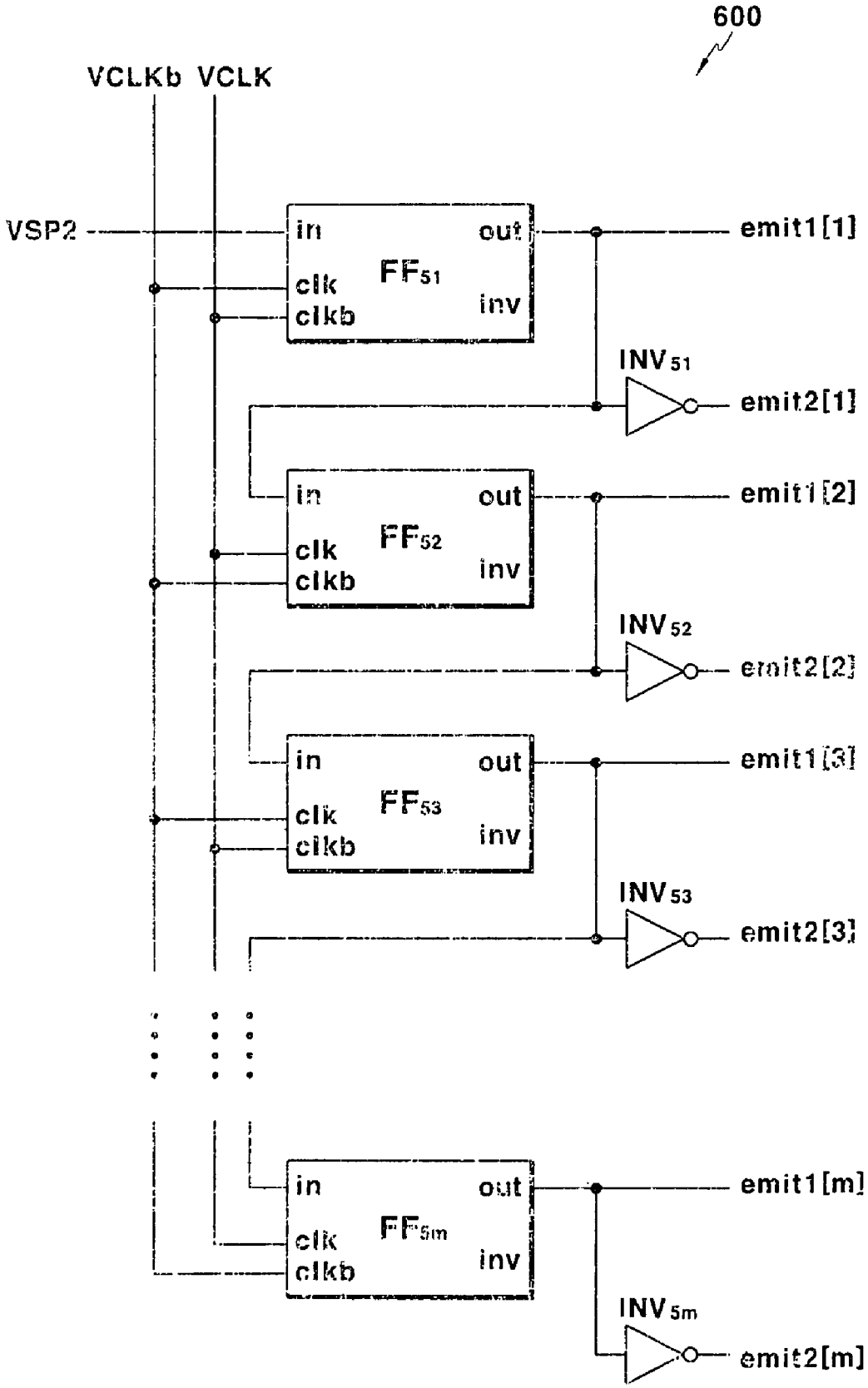
FIGS. 15, 16, and 18 show emit scan drivers in the organic light emitting displays according to fifth, sixth, and seventh exemplary embodiments of the present invention, respectively.

Referring to FIG. 15, the emit scan driver 600 according to the fifth exemplary embodiment includes m flip-flops $FF_{51}$ to $FF_{5m}$ and m inverters $INV_{51}$ to $INV_{5m}$, and operates as a shift register. The clock VCLK shown in FIG. 3 is input to the emit scan driver 600. The flip-flop $FF_{5i}$ has the same connection and structure as the flip-flop $FF_{2i}$ shown in FIG. 6. The start signal VSP2 shown in FIG. 3 is input to the flip-flop $FF_{5i}$.

An output signal of the $i^{th}$ flip-flop $FF_{5i}$ becomes the emission control signal emit1[i] of the emission control signal line $E_{1i}$ on the $i^{th}$ row, an input signal of the $(i+1)^{th}$ flip-flop $FF_{5(i+1)}$, and an input signal of the $i^{th}$ inverter $INV_{5i}$. An output signal of the $i^{th}$ inverter $INV_{5i}$ is the emission control signal emit2[i] of the emission control signal line $E_{2i}$ on the $i^{th}$ row, and the emission control signal emit2[i] is inverted to the emission control signal emit1[i] by the inverter $INV_{5i}$.

Accordingly, the emit scan driver 600 can sequentially output the emission control signals emit1[1] to emit1[m], which respectively have the low-level pulses in a period which corresponds to the subfield 1F, by shifting the half clock VCLK cycle. The emit scan driver 600 inverts the emission control signals emit1[1] to emit1[m] to thus sequentially output the emission control signals emit2[1] to emit2[m], which respectively have the low-level pulses in a period which corresponds to the subfield 2F, by shifting the half clock VCLK cycle.

Referring FIG. 4B, since the input signal of the inverter 212 is inverted to the output signal (out), the input signal of the inverter 212 can be an inverted output signal (inv) of the flip-flop. Therefore, the inverted output signal (inv) can be used as the emission control signal emit2[i], and the inverter $INV_{5i}$ can be eliminated in the emit scan driver 600.

Figure 16:
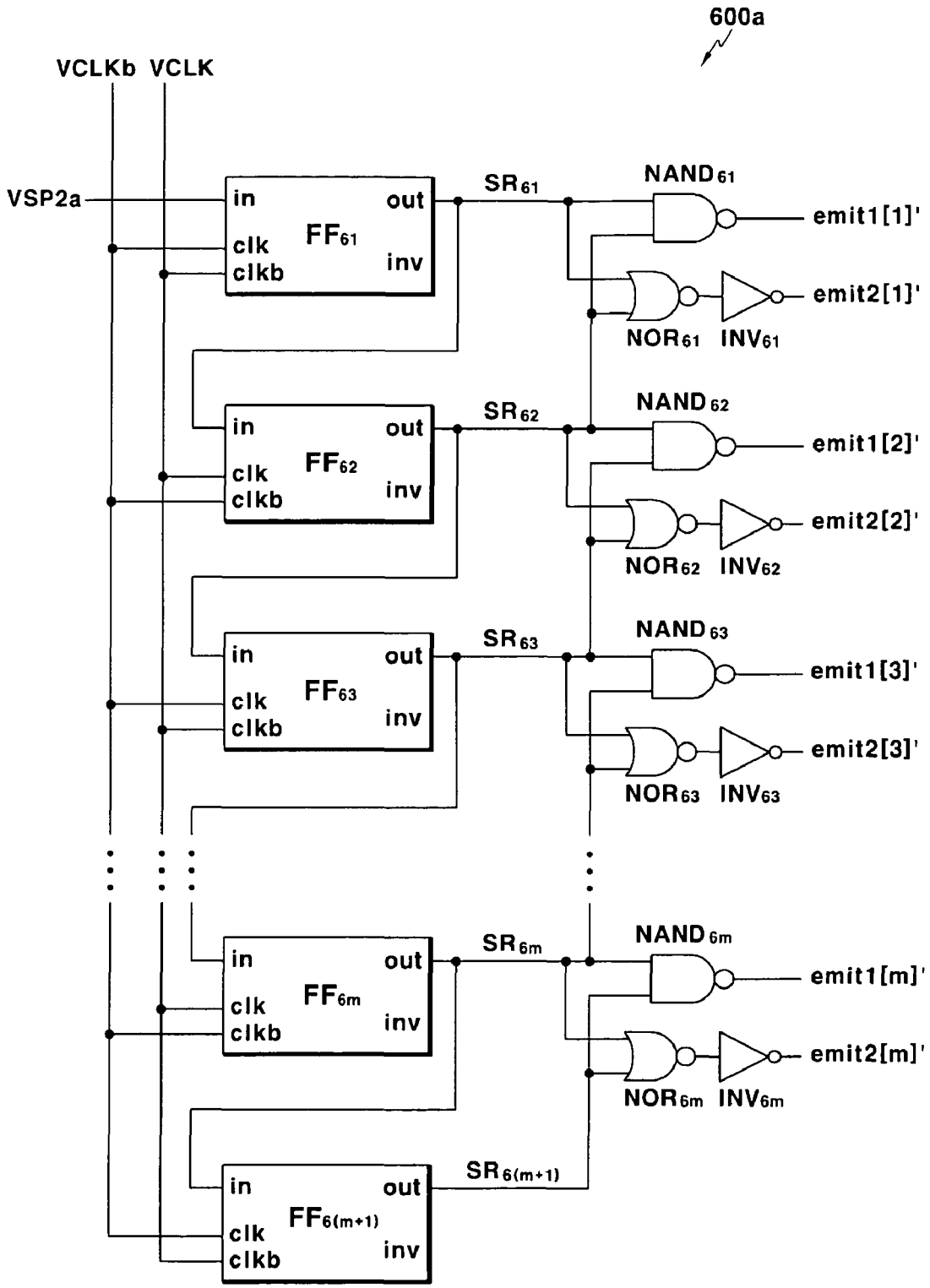
Figure 17:
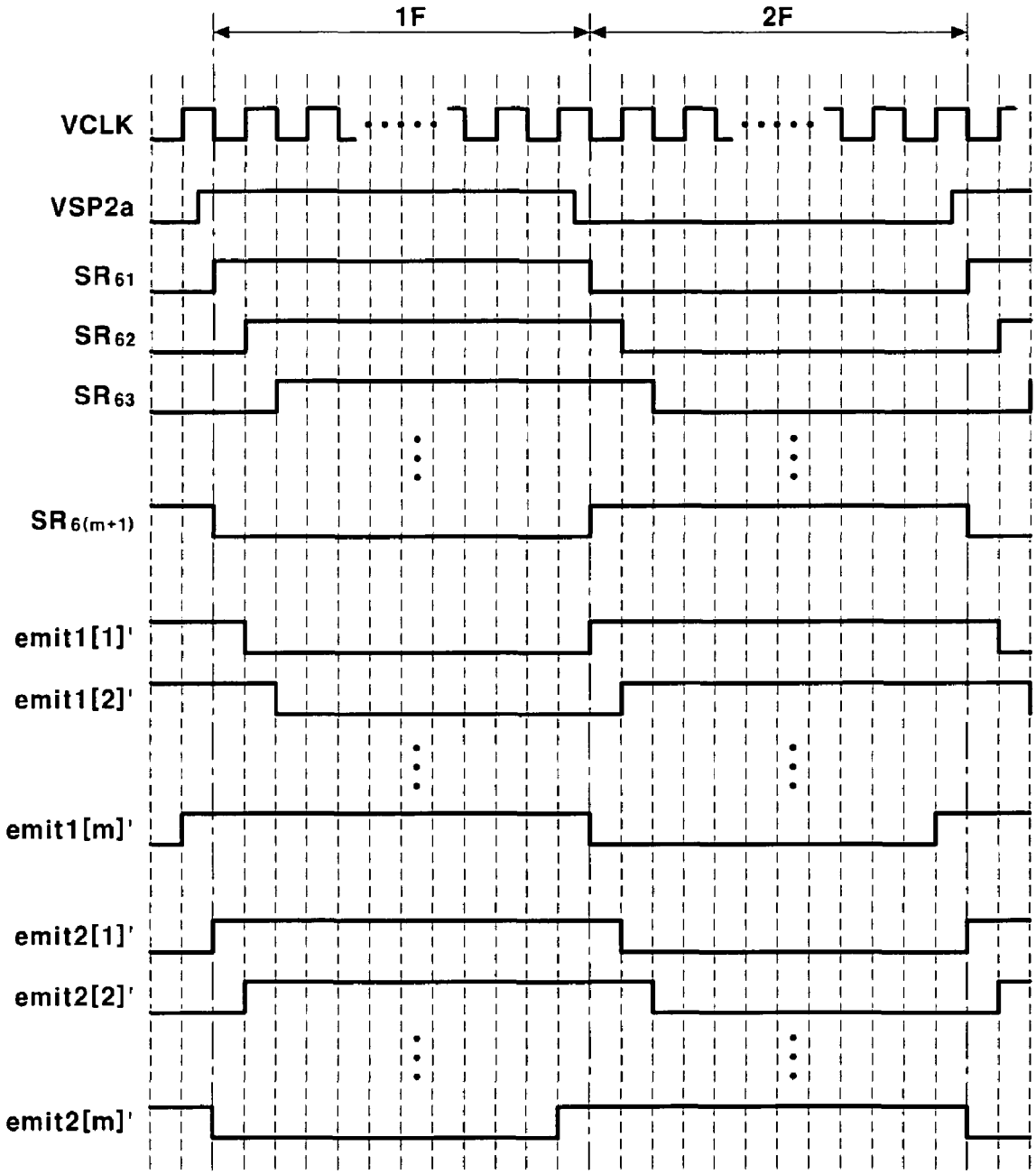
FIG. 17 shows a signal timing diagram in the emit scan driver of FIG. 16.

An emit scan driver 600*a* for generating the signal timing shown in FIG. 8 will be described with reference to FIGS. 16 and 17. FIG. 16 shows the emit scan driver 600*a* in an organic light emitting display according to a sixth exemplary embodiment, and FIG. 17 shows a signal timing diagram of the emit scan driver 600*a* shown in FIG. 16.

The emit scan driver 600*a* may generate one, for example, emit1[i]' of the emission control signals emit1[i]', emit2[i]' as does the emit scan driver 300*a* shown in FIG. 9, and may generate the emission control signal emit2[i] from the emission control signal emit1[i].

Referring FIG. 16, the emit scan driver 600*a* according to the sixth exemplary embodiment includes (m+1) flip-flops $FF_{61}$ to $FF_{6(m+1)}$, m NAND gates $NAND_{61}$ to $NAND_{6m}$, m NOR gates $NOR_{61}$ to $NOR_{6m}$, and m inverters $INV_{61}$ to $INV_{6m}$, and operates as a shift register. The clock VCLK shown in FIG. 3 is input to the emit scan driver 600. An output signal of the $i^{th}$ NAND gate $NAND_{6i}$ is the emission control signal emit1[i]' of the emission control signal line $E_{1i}$ on the $i^{th}$ row, and a signal which is inverted to an output signal NOR gate $NOR_{6i}$ by the inverter $INV_{6i}$ is the emission control signal emit2[i]' of the emission control signal line $E_{2i}$ on the $i^{th}$ row.

The flip-flop $FF_{5i}$ and the NAND gate $NAND_{6i}$ have the same connection and structure as the flip-flop $FF_{2i}$ and the NAND gate $NAND_{2i}$ shown in FIG. 9. The start signal VSP2*a* shown in FIGS. 8 and 17 is input to the flip-flop $FF_{61}$. Then, as shown in FIG. 9, the NAND gates $NAND_{61}$ to $NAND_{6m}$ can sequentially output the emission control signals emit1[i]' to emit1[m]', which respectively have the low-level pulses in a period which corresponds to a difference between the subfield 1F and the half clock VCLK cycle, by shifting the half clock VCLK cycle.

The NOR gate $NOR_{6i}$ performs a NOR operation between the output signal $SR_{6i}$, $SR_{6(i+1)}$ of the flip-flops $FF_{6i}$, $FF_{6(i+1)}$ to output an output signal to the inverter $INV_{6i}$. Here, the NOR gate $NOR_{6i}$ and the inverter $INV_{6i}$ operate as an OR gate.

Referring to FIG. 17, the output signal $SR_{6i}$ of the flip-flops $FF_{6i}$ has the low-level pulse in a period which corresponds to the subfield 2F, and the NOR gate $NOR_{6i}$ outputs the high-level pulse while both the output signal $SR_{6i}$, $SR_{6(+1)}$ of the flip-flops $FF_{6i}$, $FF_{6(i+1)}$ are the low level. Accordingly, the output signal of the NOR gate $NOR_{6i}$ has the high-level pulse in a period which corresponds to a difference between the subfield 2F and the half clock VCLK cycle, and the inverter $INV_{6i}$ inverts the output signal of the NOR gate $NOR_{6i}$ to output the emission control signal emit2[i]'. In addition, since the output signal of the NOR gate $NOR_{6(i+1)}$ is shifted from the output signal of the NOR gate $NOR_{6i}$ by the half clock VCLK cycle, the emission control signals emit2[1]' to emit2[m]' can be sequentially output by being shifted by the half clock VCLK cycle.

In the sixth exemplary embodiment, the emission control signals emit1[i]', emit2[i]' are generated by a NAND operation and a NOR operation, respectively, but the emission control signal emit2[i]' may be generated by a NAND operation.

Referring to FIGS. 8 and 17, the emission control signal emit2[i]' in the subfield 2F has the waveform shifted from the emission control signal emit1[i]', and the output signal $SR_{6i}$ of the flip-flop $FF_{6i}$ in the subfield 2F has the waveform inverted to the waveform of the output signal $SR_{6i}$ in the subfield 1F. Therefore, the emission control signal emit2[i]' can be generated from a NAND operation of a signal inverted to the output signal $SR_{6i}$. This exemplary embodiment will be described with reference to FIGS. 18 and 19.

Figure 18:
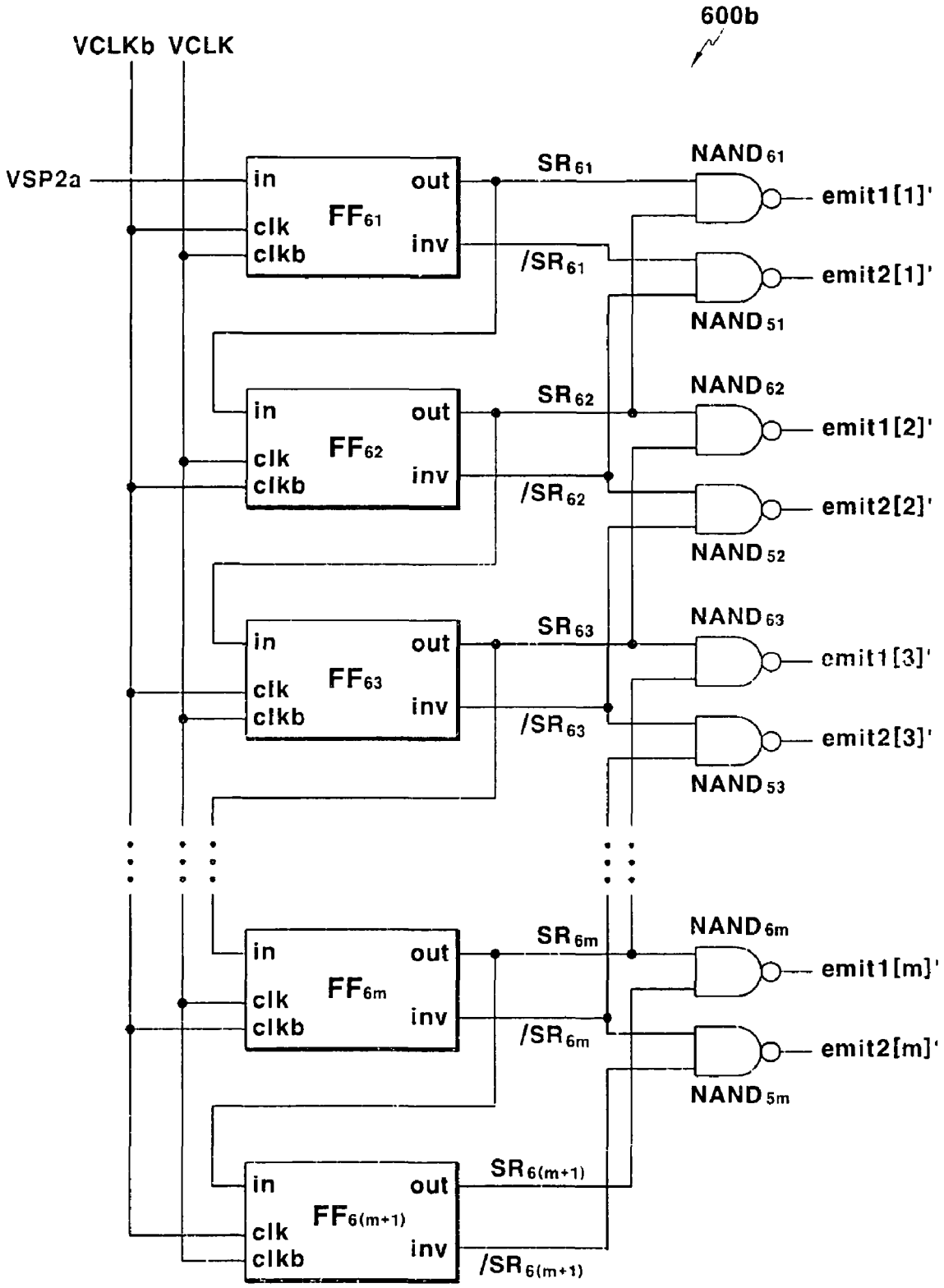
Figure 19:
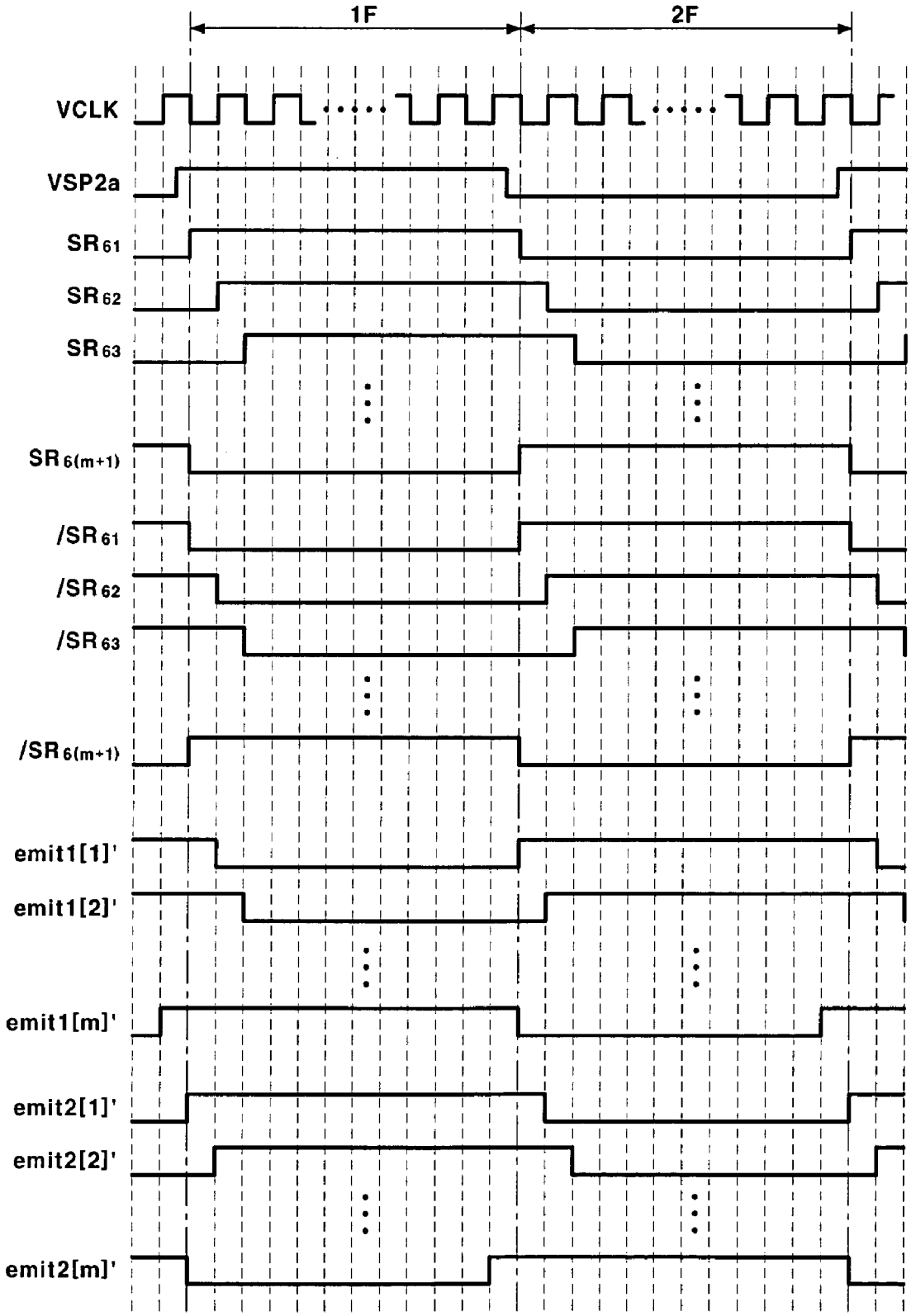
FIGS. 19 and 20 show signal timing diagrams in the emit scan driver of FIG. 18, respectively.

FIG. 18 shows an emit scan driver 600*b* in an organic light emitting display according to a seventh exemplary embodiment, and FIG. 19 shows a signal timing diagram of the emit scan driver 600*b* shown in FIG. 18.

Referring to FIG. 18, the emit scan driver 600*b* according to the seventh exemplary embodiment has the same structure as the emit scan driver 600*a* shown in FIG. 16 except for the NAND gate $NAND_{5i}$. In more detail, the emit scan driver 600*b* includes the flip-flops $FF_{61}$ to $FF_{6(m+1)}$ and the NAND gates $NAND_{61}$ to $NAND_{6m}$ shown in FIG. 16, and includes m NAND gates $NAND_{51}$ to $NAND_{5m}$ instead of the NOR gates $NOR_{61}$ to $NOR_{6m}$ and the inverters $INV_{61}$ to $INV_{6m}$.

As shown in FIG. 4B, since the input signal (inv) of the inverter 212 is inverted to the output signal of the flip-flop $FF_{6i}$, the input signal (inv) becomes an inverted output signal $/SR_{6i}$ of the flip-flop $FF_{6i}$. The NAND gate $NAND_{5i}$ performs a NAND operation between the inverted output signals $/SR_{6i}$, $/SR_{6(i+1)}$ of the flip-flops $FF_{6i}$, $FF_{6(i+1)}$ to output the emission control signal emit2[i]'.

Referring to FIG. 19, since the waveform of the inverted output signal $/SR_{6i}$ in the subfield 2F is the same as the waveform of the output signal $SR_{6i}$ in the subfield 1F, the emission control signal emit2[i]' which is the output signal of the NAND gate $NAND_{5i}$ has the signal timing shown in FIGS. 8 and 19.

In the sixth and seventh exemplary embodiments, the emission control signal emit1[i]' has the low-level pulse in the period which corresponds to the difference between the subfield 1F and the half clock VCLK cycle. Here, the low-level period of the emission control signal emit1[i]' can be controlled by changing the input signals of the NAND gate and/or NOR gate as shown in FIG. 20.

Figure 20:
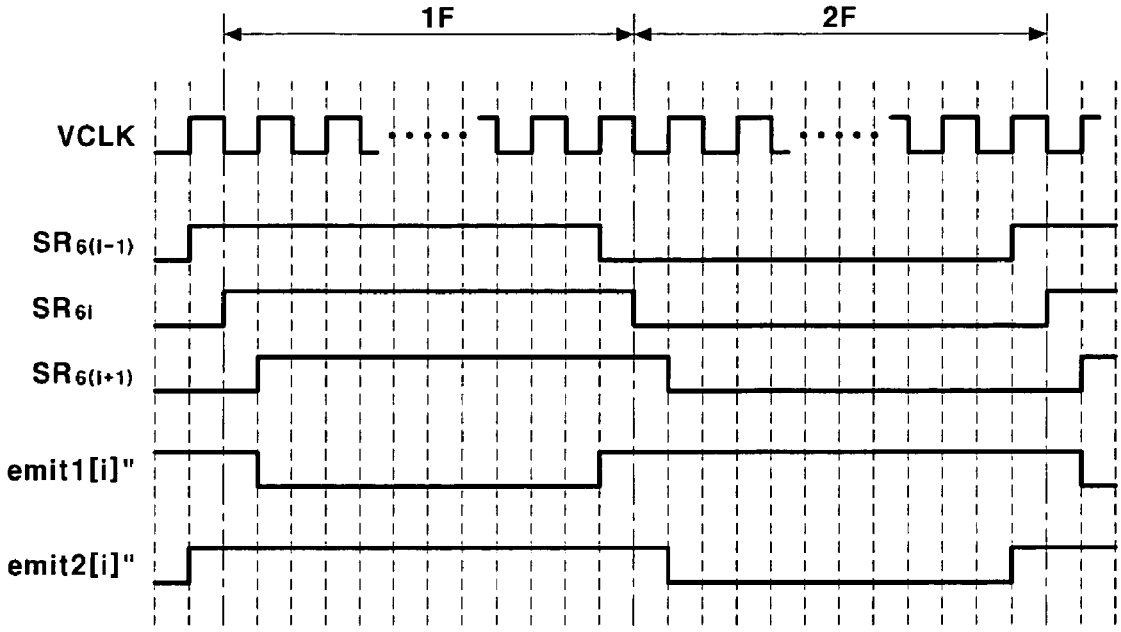

Referring to FIG. 20, the output signals $SR_{6(i-1)}$, $SR_{6(i+1)}$ of the $(i-1)^{th}$ and $(i+1)^{th}$ flip-flops $FF_{6(i-1)}$, $FF_{6(i+1)}$ are input to the $i^{th}$ NAND gate $NAND_{6i}$ and the $i^{th}$ NOR gate $NOR_{6i}$ shown in FIG. 16. The emission control signal emit1[i]" has the low-level pulse in a period which corresponds to a difference between the subfield 1F and the one clock VCLK cycle, and the emission control signal emit2[i]" has the low-level pulse in a period which corresponds to a difference between the subfield 2F and the one clock VCLK cycle.

Figure 21:
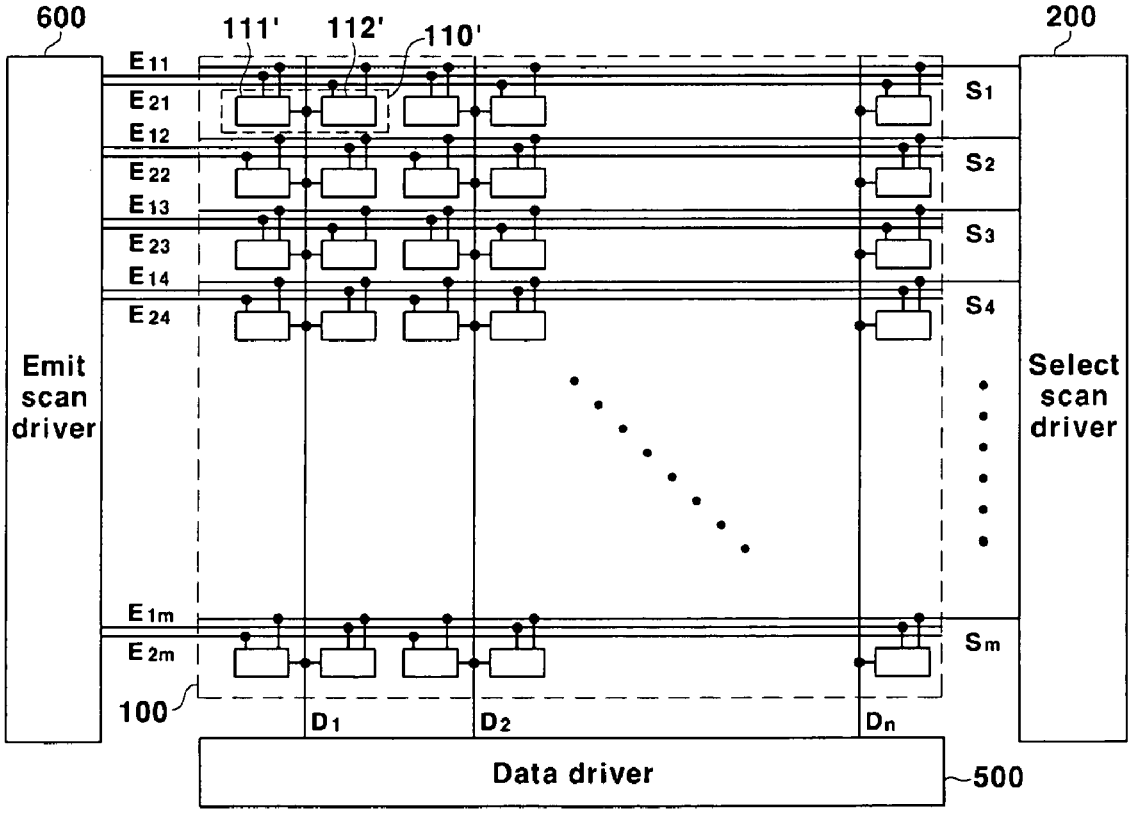
FIGS. 21 and 22 show plan views of organic light emitting displays according to eighth and ninth exemplary embodiments of the present invention, respectively.

As shown FIG. 21, the select scan driver 200 and the emit scan driver 600, 600*a*, or 600*b* may be applicable to the organic light emitting display shown in FIG. 13. FIG. 21 shows a plan view of the organic light emitting display according to an eighth exemplary embodiment of the present invention.

Referring to FIG. 21, as shown in FIG. 13, the emit scan line $E_{1i}$ is coupled to the left pixels 111' of the pixel areas 110' on the $i_{th}$ row (where 'i' is an odd integer of less than 'm') and the emit scan line $E_{2i}$ is coupled to the right pixels 112' of the pixel areas 110' on the $i^{th}$ row, and the emit scan line $E_{1(i+1)}$ is coupled to the right pixels 112' of the pixel areas 110' on the $(i+1)^{th}$ row and the emit scan line $E_{2(i+1)}$ is coupled to the left pixels 112' of the pixel areas 110' on the $(i+1)^{th}$ row. In addition, the emit scan lines $E_{1i}$, $E_{2i}$, $E_{1(i+1)}$, $E_{2(i+1)}$ are coupled to the emit scan driver 600.

Next, exemplary embodiments which form the emit scan driver and the select scan driver as a unit scan driver 700 will be described with reference to FIGS. 22 to 33.

Figure 22:
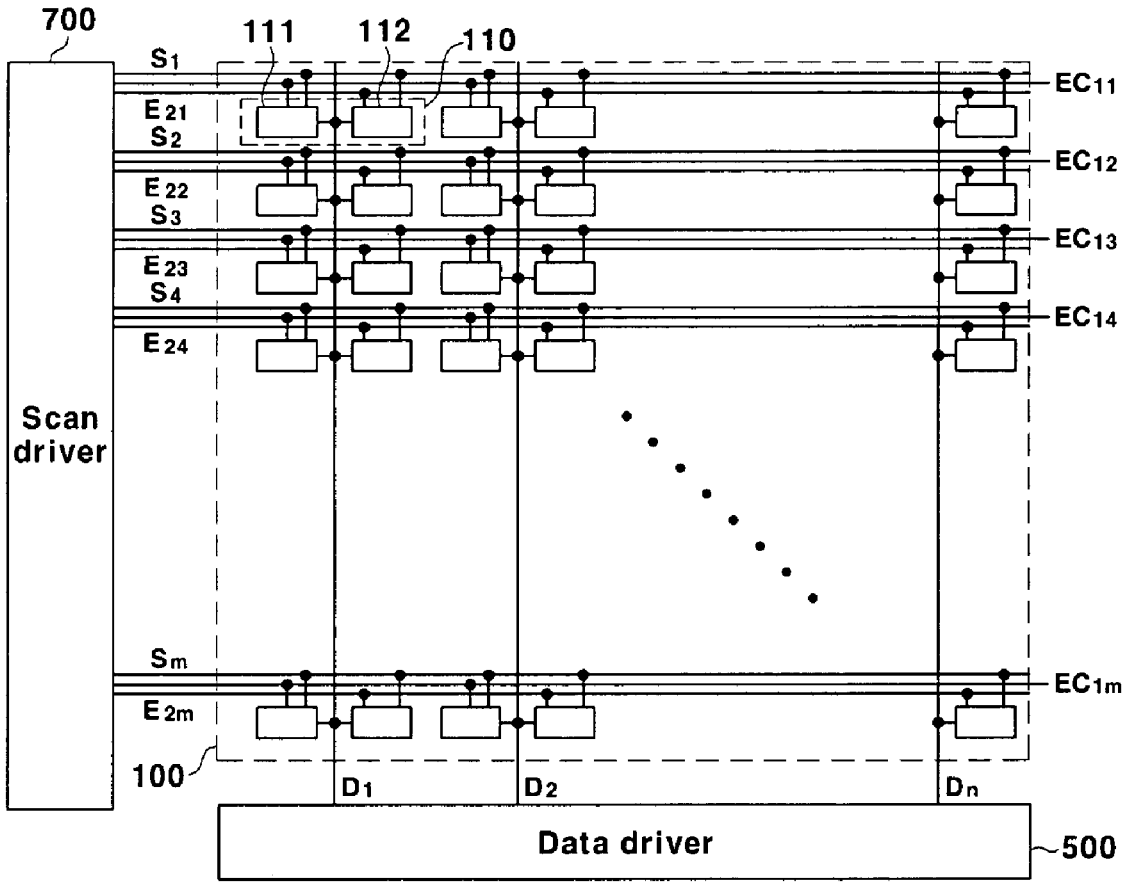

FIG. 22 shows a plan view of the organic light emitting display according to a ninth exemplary embodiment of the present invention. The organic light emitting display according to the ninth exemplary embodiment has the same structure as that shown in FIGS. 1 and 14 except for a scan driver 700 sharing the select scan driver and the emit scan driver. The scan driver 700 sequentially transmits select signals select[1] to select[m] for selecting corresponding lines to the select scan lines $S_1$ to $S_m$ in the subfields 1F and 2F. In addition, the scan driver 700 sequentially transmits emission control signals emit1[1] to emit1[m] for controlling light emission of pixels 111 to the emit scan lines $E_{11}$ to $E_{1m}$ in the subfield 1F, and sequentially transmits emission control signals emit2[1] to emit2[m] for controlling light emission of pixels 112 to the emit scan lines $E_{21}$ to $E_{2m}$ in the subfield 2F.

As described in the fifth and eighth exemplary embodiments, the scan driver can generate both emission control signals emit1[i], emit2[i]. Therefore, the method for generating the select signal select[i] from this scan driver will be described below.

Figure 23:
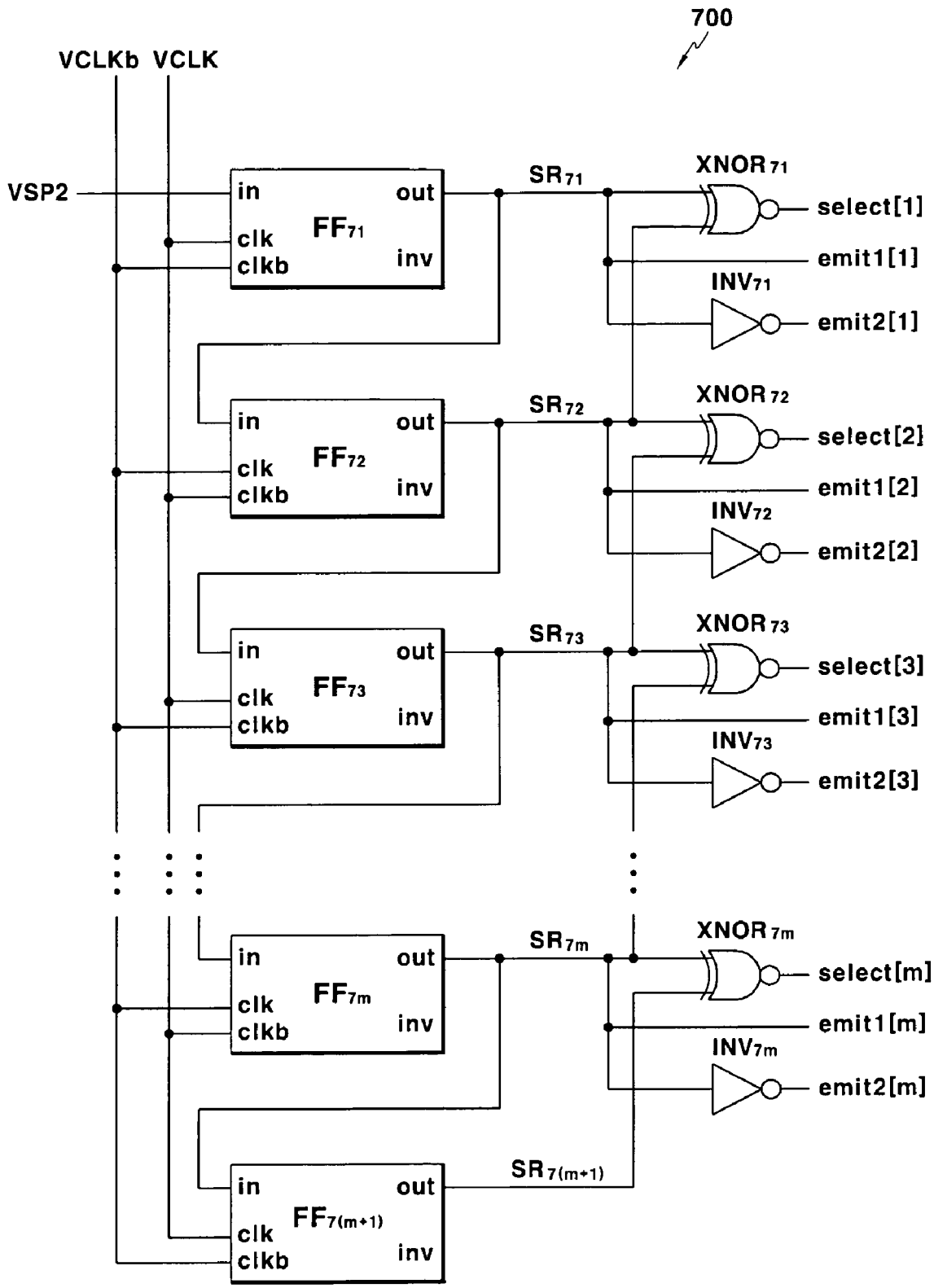
FIGS. 23, 25, 26, and 28 show scan drivers in the organic light emitting displays according to ninth, tenth, eleventh, and twelfth exemplary embodiments of the present invention, respectively.
Figure 24:
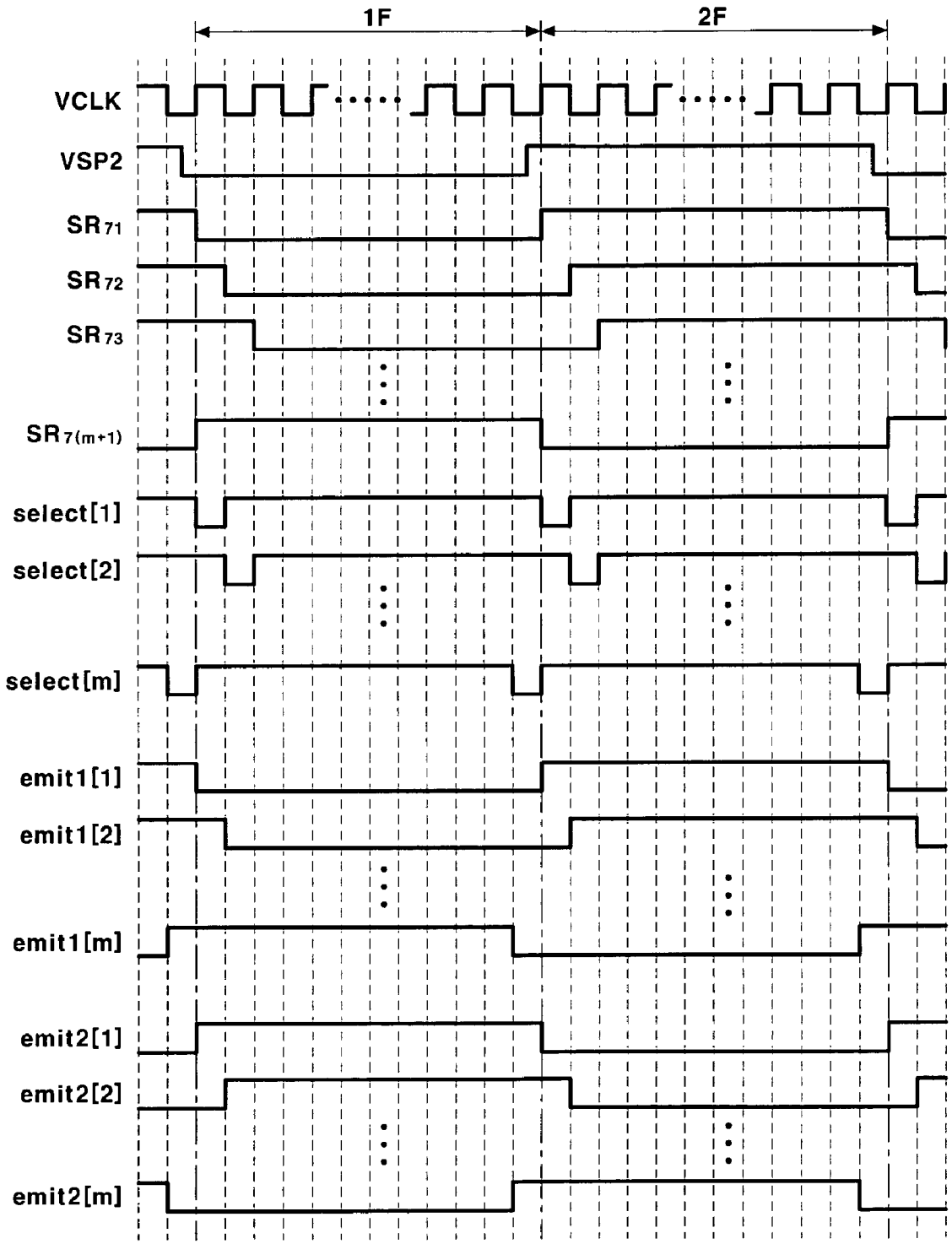
FIGS. 24 and 27 show signal timing diagrams in the scan drivers of FIGS. 23 and 26, respectively.

First, the scan driver 700 for generating the signal timing shown in FIG. 3 will be described with reference to FIGS. 23 and 24. FIG. 23 shows the scan driver 700 in the organic light emitting display according to the ninth exemplary embodiment, and FIG. 24 shows a signal timing diagram of the scan driver 700 shown in FIG. 23.

Referring to FIG. 3, the emission control signal emit2[i] is inverted to the emission control signal emit1[i], and the select signal select[i] has the low level in a period in which the level of the emission control signal emit1[i] is different from that of the emission control signal emit1[i+1]. Therefore, the scan driver 700 can generate the select signal [i] and the emission control signals emit1[i], emit2[i].

As shown in FIG. 23, the scan driver 700 includes (m+1) flip-flops $FF_{71}$ to $FF_{7(m+1)}$, m XNOR gate $XNOR_{71}$ to $XNOR_{7m}$, and m inverters $INV_{71}$ to $INV_{7m}$, and operates as a shift register. Here, an XOR gate and an inverter may be used as the XNOR gate. In addition, the clock VCLK and the start signal VSP2 shown in FIG. 15 are input to the scan driver 700.

The flip-flop $FF_{5i}$ and the inverter $INV_{7i}$ have the same connection and structure as the flip-flop $FF_{5i}$ and the inverter $INV_{5i}$ shown in FIG. 15. Therefore, an output signal $SR_{7i}$ of the flip-flop $FF_{7i}$ is the emission control signal emit1[i], and a signal which is inverted to the output signal $SR_{7i}$ of the flip-flop $FF_{7i}$ by the inverter $INV_{7i}$ is the emission control signal emit2[i].

The XNOR gate $XNOR_{7i}$ performs XNOR operation between the output signals $SR_{7i}$, $SR_{7(i+1)}$ of the flip-flops $FF_{7i}$, $FF_{7(i+1)}$ to output the select signal select[i]. That is, the XNOR gate $XNOR_{7i}$ outputs the low-level select signal select [i] while the output signals $SR_{7i}$, $SR_{7(i+1)}$ of the flip-flops $FF_{7i}$, $FF_{7(i+1)}$ have the different levels.

Referring to FIG. 24, the output signal $SR_{7(i+1)}$ of the flip-flop $FF_{7(i+1)}$ is shifted from the output signal $SR_{7i}$ of the flip-flop $FF_{7i}$ by the half clock VCLK cycle. Therefore, the output signal select[i] of the XNOR gate $XNOR_{7i}$ has the low-level pulse during the half clock VCLK cycle in the respective subfields 1F, 2F. The falling edges of the low-level pulses in the select signal select[i] respectively correspond to the falling edge and the rising edge of the output signal $SR_{7i}$ of the flip-flop $FF_{7i}$. In addition, since the output signal $SR_{7(i+1)}$ is shifted from the output signal $SR_{7i}$ by the half clock VCLK cycle, the select signal select[i+1] is shifted from the select signal select[i] by the half clock VCLK cycle.

Referring to FIG. 4B, since the inverted output signal $/SR_{7i}$ is output from the flip-flop $FF_{7i}$, the inverted output signal $/SR_{7i}$ can be used as the emission control signal emit2[i].

Figure 25:
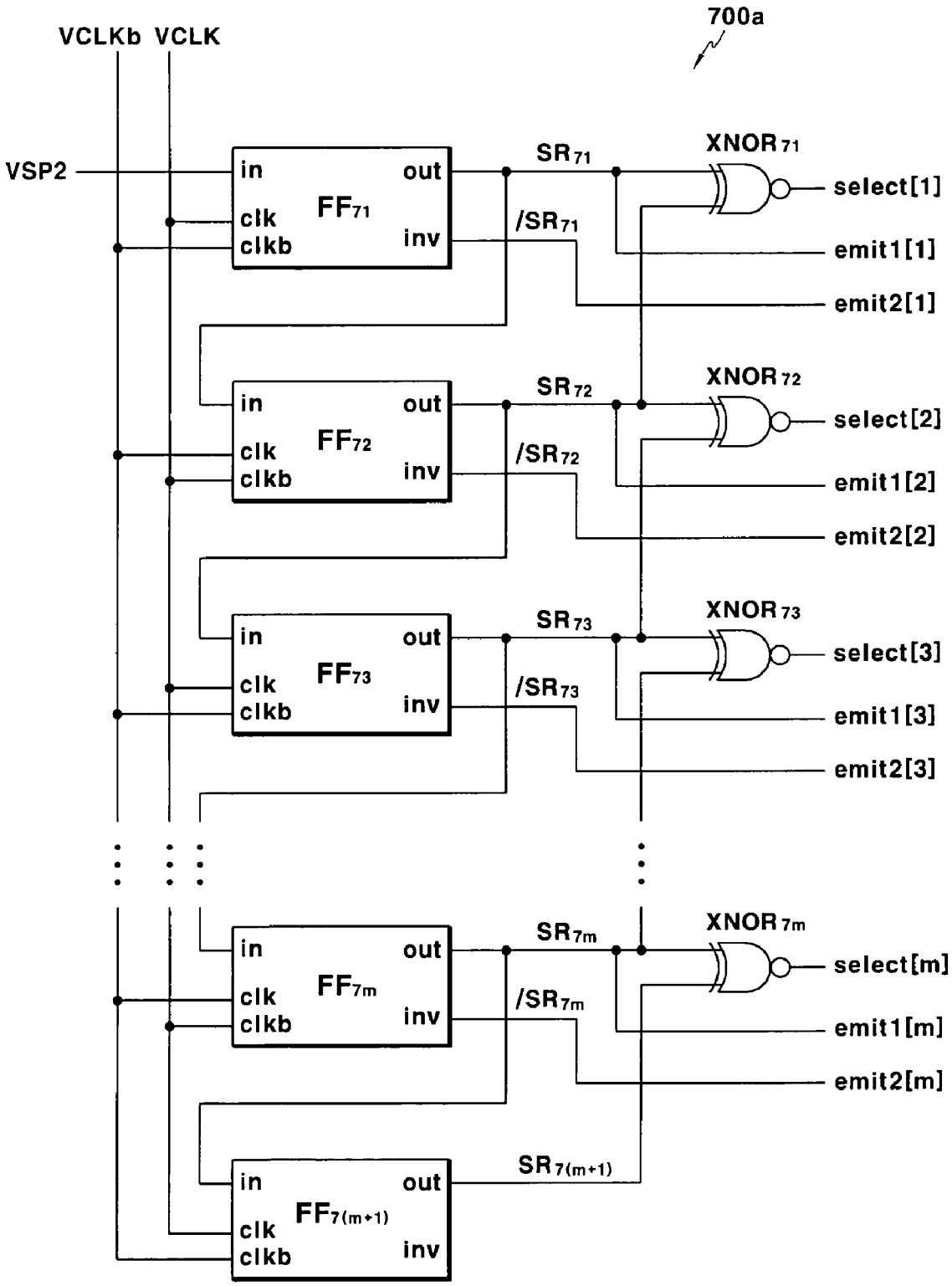

FIG. 25 shows a scan driver 700*a* in an organic light emitting display according to a tenth exemplary embodiment. Referring to FIG. 25, the scan driver 700*a* has the same structure as that shown in FIG. 23 except for the inverter $INV_{7i}$. In the scan driver 700*a*, the output signal $SR_{7i}$ and the inverted output signal $/SR_{7i}$ of the flip-flop $FF_{7i}$ correspond to the emission control signals emit1[i] and emit2[i], respectively.

Figure 26:
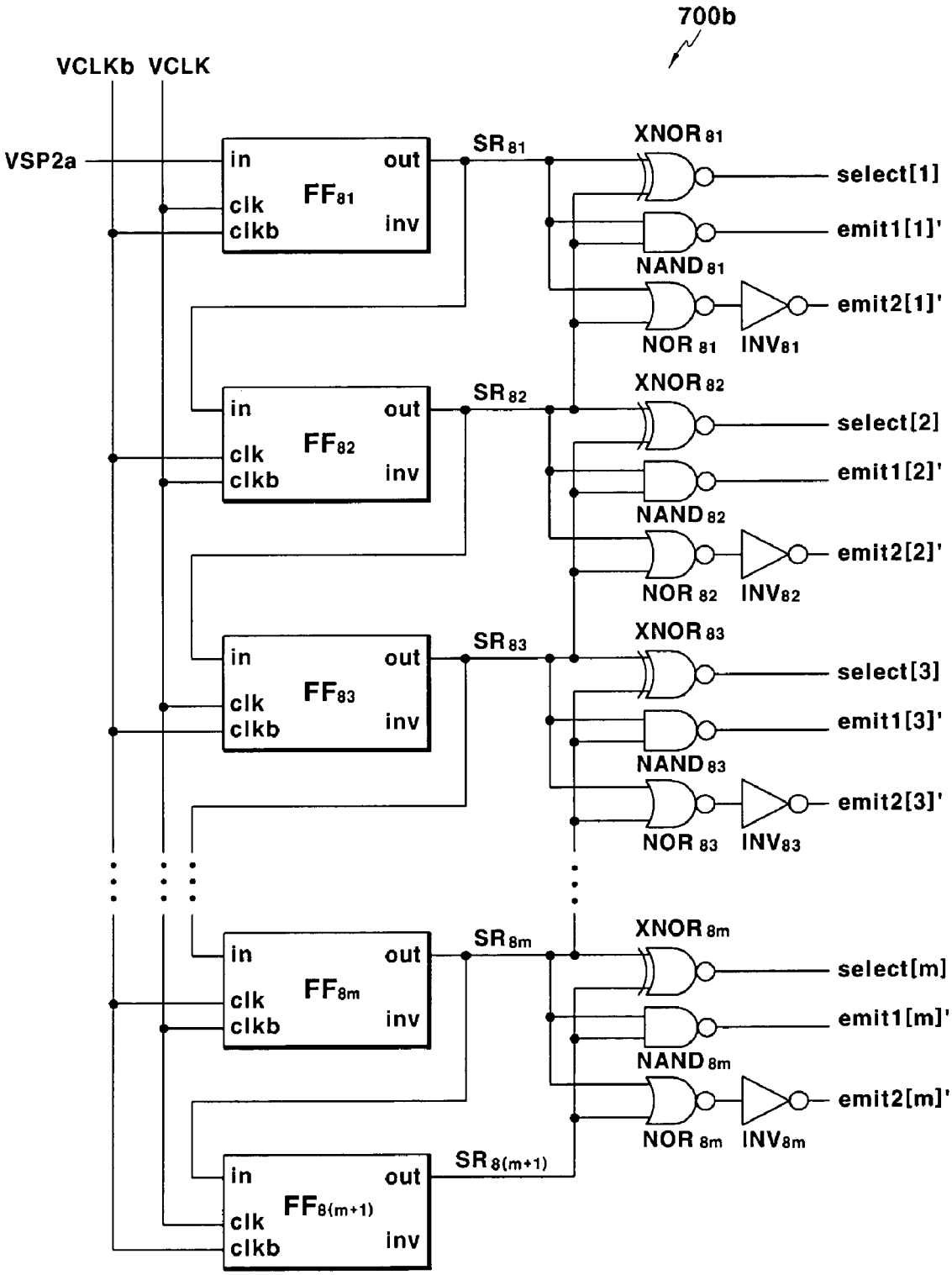
Figure 27:
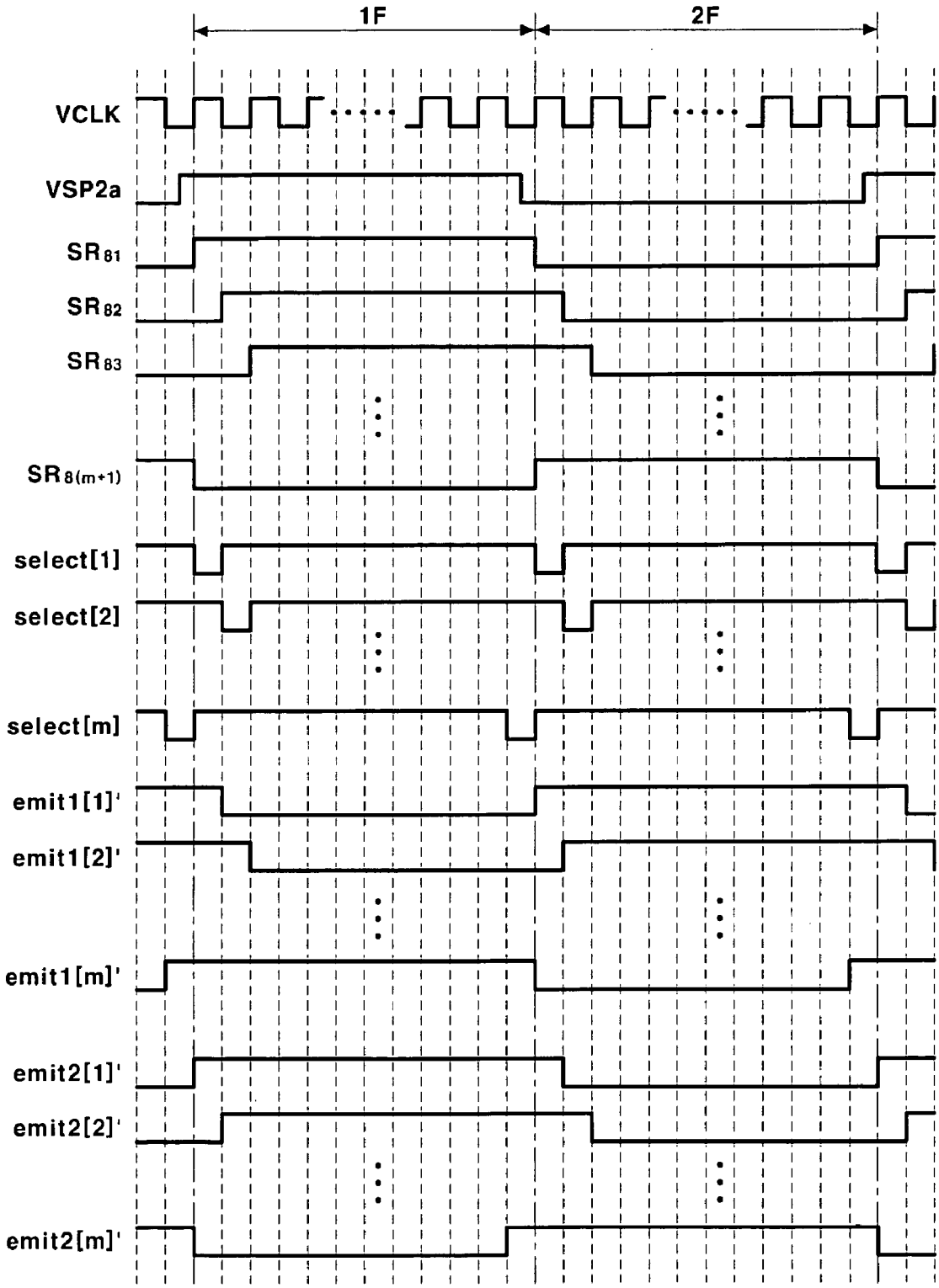

A scan driver 700*b* for generating the signal timing shown in FIG. 8 will be described with reference to FIGS. 26 and 27. FIG. 26 shows the scan driver 700*b* in an organic light emitting display according to an eleventh exemplary embodiment, and FIG. 27 shows a signal timing diagram of the scan driver 700*b* shown in FIG. 26.

As shown in FIG. 16, the scan driver 700*b* according to the eleventh exemplary embodiment includes (m+1) flip-flops $FF_{81}$ to $FF_{8(m+1)}$, m XNOR gates $XNOR_{81}$ to $XNOR_{8m}$, m NAND gates $NAND_{81}$ to $NAND_{8m}$, m NOR gates $NOR_{81}$ to $NOR_{8m}$, and m inverters $INV_{81}$ to $INV_{8m}$, and operates as a shift register. Here, the clock VCLK and the start signal VSP2*a* shown in FIG. 17 are input to the scan driver 700*b*.

The flip-flop $FF_{8i}$, the NAND gate $NAND_{8i}$, the NOR gate $NOR_{8i}$ and the inverter $INV_{8i}$ have the same connection and structure as the flip-flop $FF_{6i}$, the NAND gate $NAND_{6i}$, the NOR gate $NOR_{6i}$ and the inverter $INV_{6i}$ shown in FIG. 16. Accordingly, the NAND gate $NAND_{8i}$ performs NAND operation between the output signals $SR_{8i}$, $SR_{8(i+1)}$ of the flip-flops $FF_{8i}$, $FF_{8(i+1)}$ to output the emission control signal emit1[i]' as shown in FIG. 27. The NOR gate $NOR_{8i}$ performs a NOR operation between the output signals $SR_{8i}$, $SR_{8(i+1)}$ of the flip-flops $FF_{8i}$, $FF_{8(i+1)}$ to output an output signal to the inverter $INV_{8i}$, and the inverter $INV_{8i}$ inverts the signal input from the NOR gate $NOR_{8i}$ to output the emission control signal emit2[i]' as shown in FIG. 27.

In addition, the flip-flop $FF_{8i}$ and the XNOR gate $XNOR_{8i}$ have the same connection as the flip-flop $FF_{7i}$ and the XNOR gate $XNOR_{7i}$ shown in FIG. 23. Therefore, the XNOR gate $XNOR_{8i}$ performs the output signals $SR_{8i}$, $SR_{8(i+1)}$ of the flip-flops $FF_{8i}$, $FF_{8(i+1)}$ to output the select signal select[i].

In the eleventh exemplary embodiment, the scan driver 700*b* uses the start signal VSP2*a* which is inverted to the start signal VSP2 shown in FIG. 24. However, the scan driver 700*b* may use the start signal VSP2 shown in FIG. 24. Then, since the output signal of the flip-flop $FF_{8i}$ is inverted to the output signal $SR_{8i}$ shown in FIG. 27, the output signal of the NAND gate $NAND_{8i}$ corresponds to the emission control signal emit2[i]' and the output signal of the inverter $INV_{8i}$ corresponds to the emission control signal emit1[i]'.

In addition, the scan driver 700*b* may use the inverted output signal of the flip-flop $FF_{8i}$. That is, a NAND gate may be used instead of the NOR gate $NOR_{8i}$ and the inverter $INV_{8i}$, and the NAND gate may perform a NAND operation between the inverted output signals of the flip-flops $FF_{8i}$, $FF_{8(j+1)}$ to output the emission control signal emit2[i]'.

Figure 28:
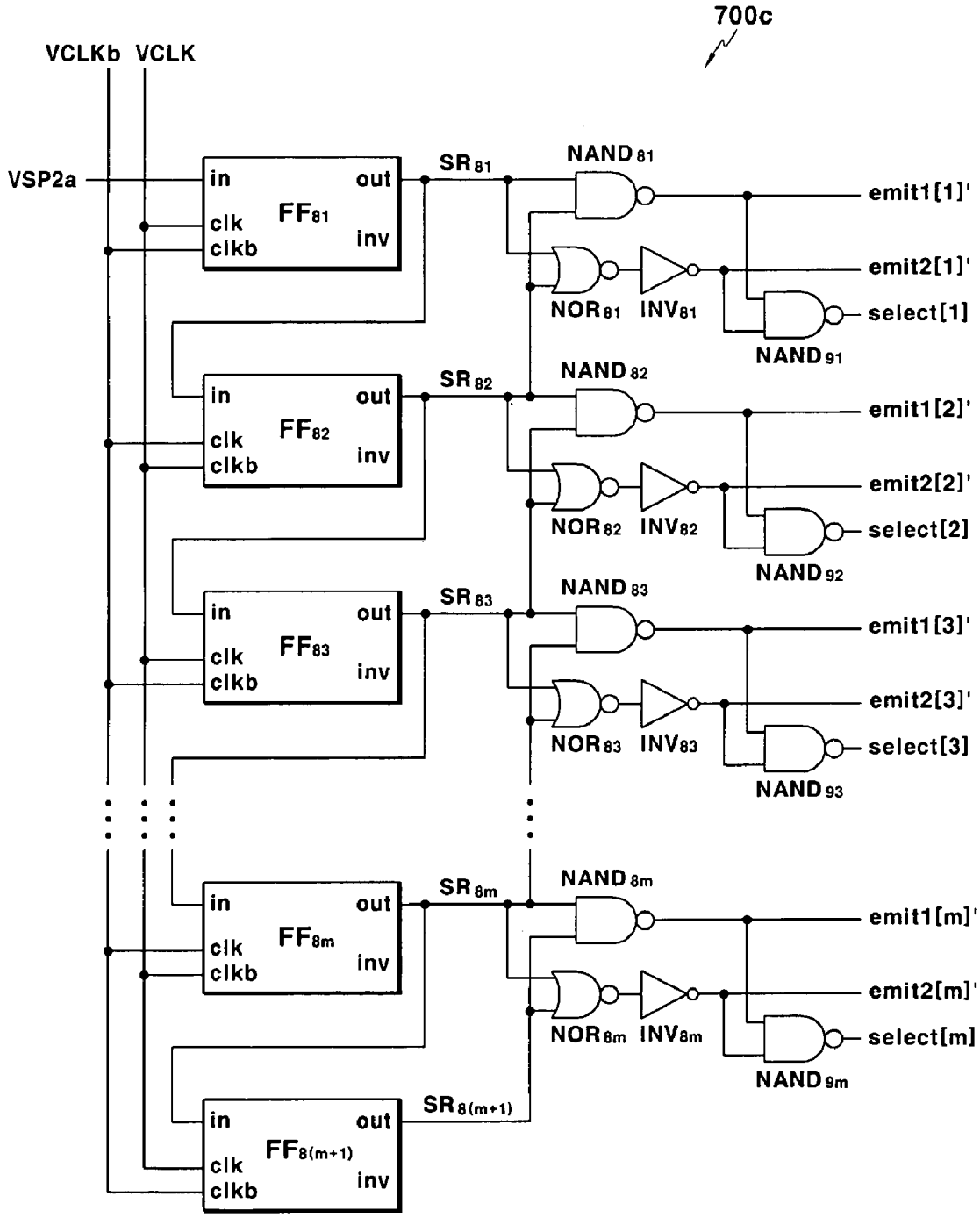

Furthermore, the select signal select[i] may be generated from the emission control signals emit1[i]', emit2[i]'. This exemplary embodiment will be described with reference to FIG. 28. FIG. 28 shows a scan driver 700*c* in an organic light emitting display according to a twelfth exemplary embodiment.

As shown in FIG. 28, the scan driver 700*c* according to the twelfth exemplary embodiment has the same structure as the scan driver 700*b* shown in FIG. 26 except for a NAND gate $NAND_{9i}$ for generating the select signal select[i]. The NAND gate $NAND_{9i}$ performs a NAND operation between the emission control signals emit1[i]', emit2[i]' to output the select signal select[i].

Referring to FIG. 27, both emission control signals emit1[i]', emit2[i]' are high level in the low-level period of the select signal select[i], and one of the emission control signals emit1[i]', emit2[i]' is low level in the high-level period of the select signal select[i]. Here, since the output signal of the NAND gate $NAND_{9i}$ is the low-level while the both emission control signals emit1[i]', emit2[i]' are the high-level, the output signal of the NAND gate $NAND_{9i}$ can be used as the select signal select[i].

Also, if the scan driver 700*c* uses the inverted output signal of the flip-flop $FF_{8i}$, a NAND gate may be used instead of the NOR gate $NOR_{8i}$ and the inverter $INV_{8i}$.

In the eleventh and twelfth exemplary embodiments, the low-level periods of the emission control signals emit1[i]', emit2[i]' may be controlled, as shown in FIG. 20. These exemplary embodiments will be described with reference to FIGS. 29 to 32.

Figure 29:
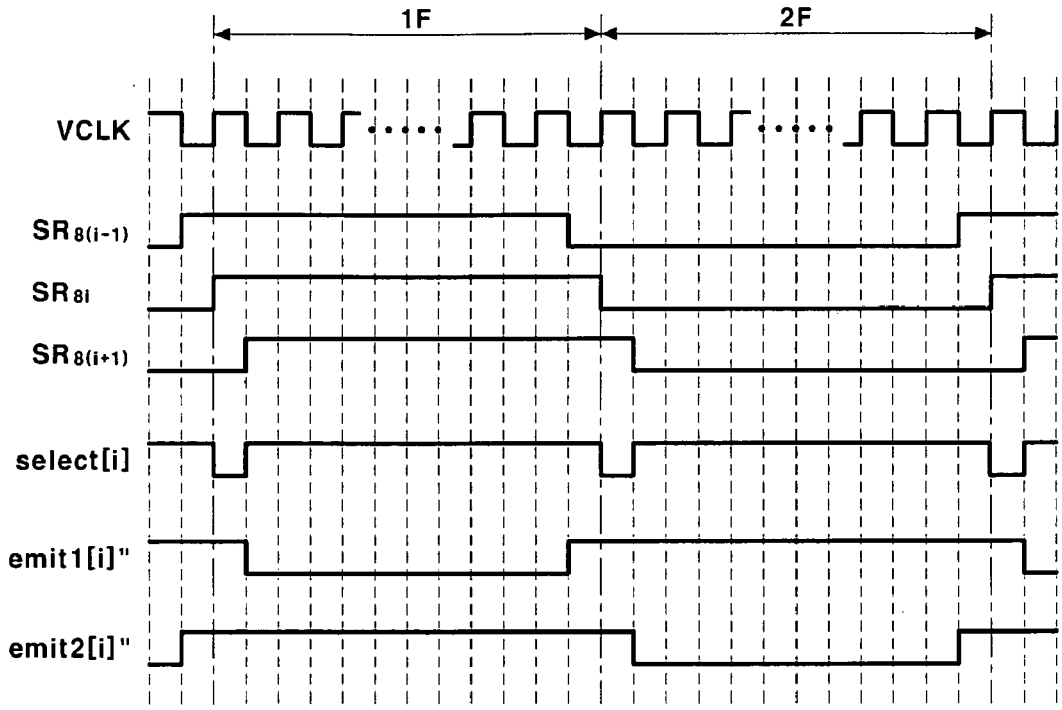
FIG. 29 shows a signal timing diagram in a scan driver according to a thirteenth exemplary embodiment of the present invention.

First, a thirteenth exemplary embodiment which controls the low-level periods of the emission control signals emit1[i]', emit2[i]' in the scan driver 700*b* shown in FIG. 26 will be described with reference to FIG. 29. FIG. 29 shows a signal timing diagram of the scan driver 700*b* in an organic light emitting display according to the thirteenth exemplary embodiment.

Referring to FIG. 29, the output signals $SR_{8(i-1)}$, $SR_{8(i+1)}$ of the $(i-1)^{th}$ and $(i+1)^{th}$ flip-flops $FF_{8(i-1)}$, $FF_{8(i+1)}$ are input to the $i^{th}$ NAND gate $NAND_{8i}$ and the $i^{th}$ NOR gate $NOR_{8i}$ shown in FIG. 26. Then, the emission control signal emit1[i]" has the low-level pulse in a period which corresponds to a difference between the subfield 1F and the one clock VCLK cycle, and the emission control signal emit2[i]" has the low-level pulse in a period which corresponds to a difference between the subfield 2F and the one clock VCLK cycle.

In a like manner, if the output signals $SR_{8(i-1)}$, $SR_{8(i+k)}$ of the $(i-j)^{th}$ and $(i+k)^{th}$ flip-flops $FF_{8(i-j)}$, $FF_{8(i+k)}$ (where 'j' and 'k' are respectively positive integers) are input to the $i^{th}$ NAND gate $NAND_{8i}$ and the $i^{th}$ NOR gate $NOR_{8i}$, the low-level periods of the emission control signals emit1[i]", emit2[i]" may be controlled by the integral multiple of the half clock VCLK cycle.

Figure 30:
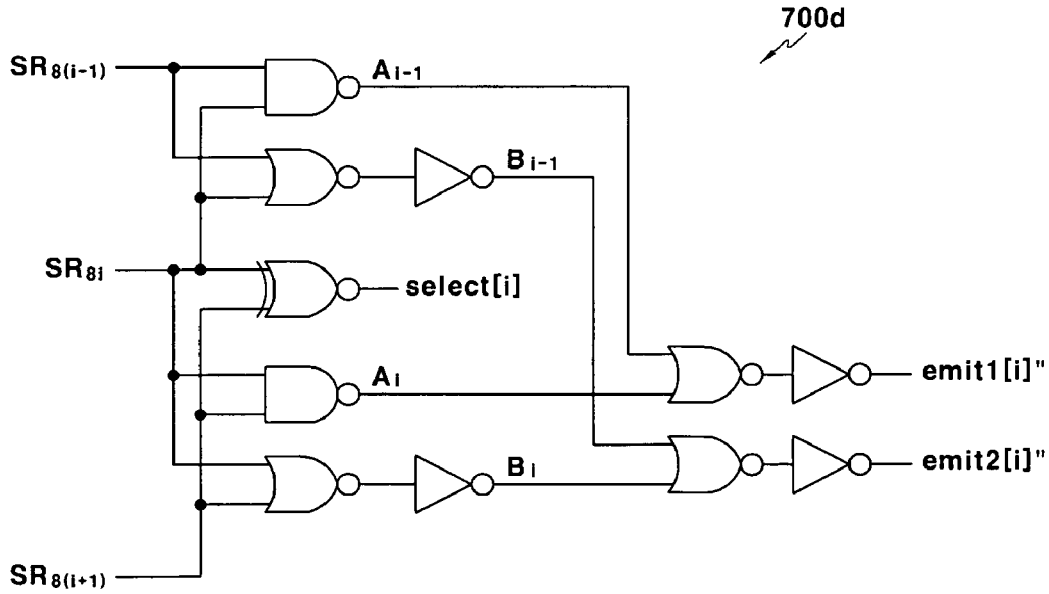
FIGS. 30 and 32 show scan drivers in the organic light emitting displays according to fourteenth and fifteenth exemplary embodiments of the present invention, respectively.
Figure 31:
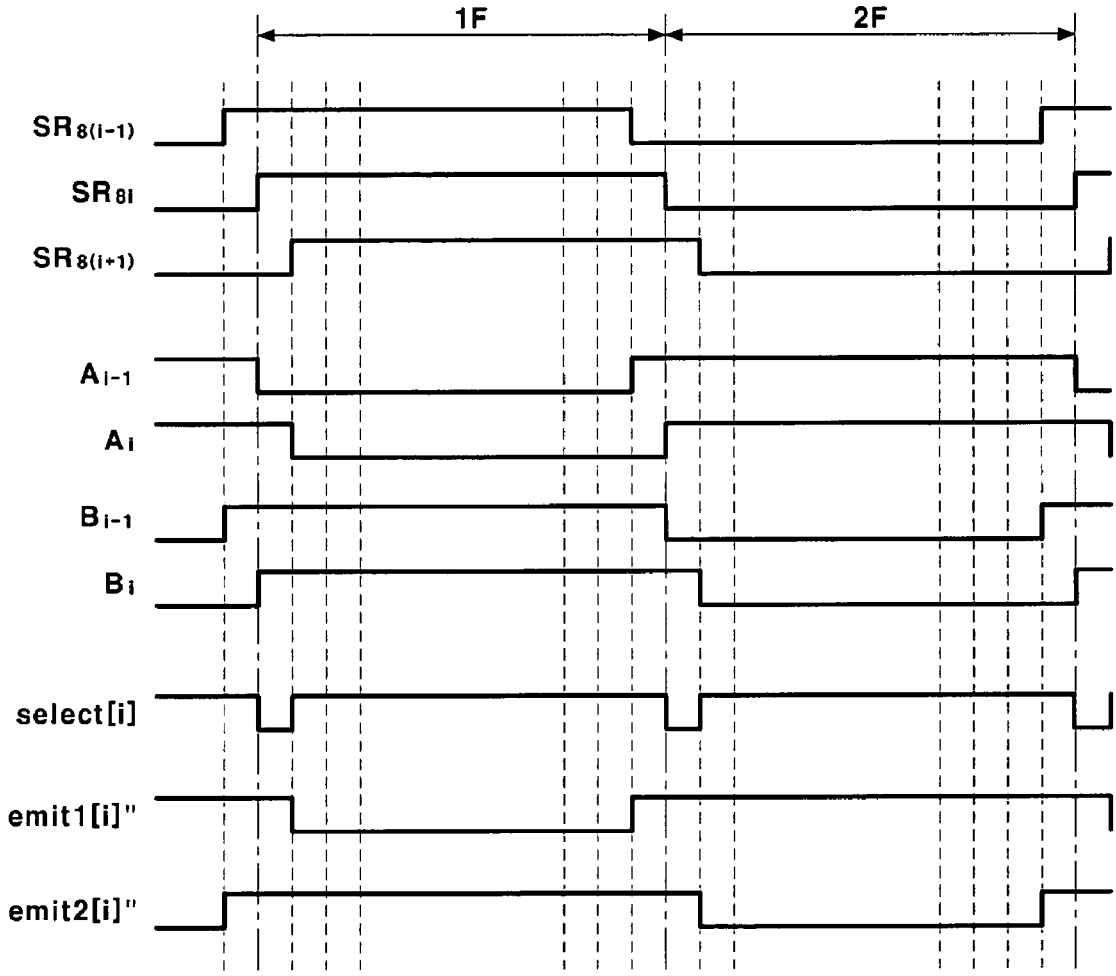
FIG. 31 shows a signal timing diagram in the scan driver of FIG. 30.

FIG. 30 shows a scan driver 700*d* in an organic light emitting display according to a fourteenth exemplary embodiment, and FIG. 31 shows a signal timing diagram of the scan driver 700*d* shown in FIG. 31.

In FIG. 30, the signals $SR_{8(i-1)}$, $SR_{8i}$, $SR_{8(i+1)}$ are the output signals of the flip-flops $FF_{8(i-1)}$, $FF_{8i}$, $FF_{8(i+1)}$ in the scan driver 700*b* of FIG. 26, respectively. In addition, two signals $A_i$, $B_i$ correspond to the emission control signals emit1[i]', emit2[i]' of the scan driver 700*b*, respectively.

Referring to FIGS. 30 and 31, the NAND operation of the output signals $SR_{8(i-1)}$, $SR_{8i}$ of the flip-flops $FF_{8(i-1)}$, $FF_{8i}$ is performed by a NAND gate so that the signal $A_{i-1}$ is output. The signal $A_{i-1}$ has the low-level pulse in a period which corresponds to the subfield 1F and the half clock VCLK cycle, and corresponds to the emission control signal emit1[i−1]' shown in FIG. 27. The OR operation of the output signals $SR_{8(i-1)}$, $SR_{8i}$ of the flip-flops $FF_{8(i-1)}$, $FF_{8i}$ is performed by a NAND gate and an inverter so that the signal $B_{i-1}$ is output. The signal $B_{i-1}$ has the low-level pulse in a period which corresponds to the subfield 2F and the half clock VCLK cycle, and corresponds to the emission control signal emit2[i−1]' shown in FIG. 27. In addition, the signals $A_i$, $B_i$ respectively correspond to the emission control signals emit1[i]', emit2[i]' shown in FIG. 27, and are respectively shifted from the signals $A_{i-1}$, $B_{i-1}$ by the half clock VCLK cycle.

Furthermore, the OR operation of the signals $A_{i-1}$, $A_i$ is performed by a NAND gate and an inverter so that the emission control signal emit1[i]" is output, and the emission control signal emit1[i]" has the low-level pulse while both signals $A_{i-1}$, $A_i$ are low level. The OR operation of the signals $B_{i-1}$, $B_i$ is performed by a NAND gate and an inverter so that the emission control signal emit2[i]" is output, and the emission control signal emit2[i]" has the low-level pulse while both signals $B_{i-1}$, $B_i$ are low level. The XNOR operation of the output signals $SR_{8i}$, $SR_{8(i+1)}$ of the flip-flops $FF_{8i}$, $FF_{8(i+1)}$ is performed so that the select signal select[i] is output.

In FIGS. 30 and 31, if the output signals $A_{(i-j)}$, $A_{(i+k)}$ of the $(i-j)^{th}$ and $(i+k)^{th}$ NAND gates (where 'j' and 'k' are respectively positive integers) are used, the low-level periods of the emission control signals emit1[i]", emit2[i]" may be controlled by the integral multiple of the half clock VCLK cycle.

As shown in FIG. 28, the select signal select[i] can be generated by a NAND gate in FIG. 30. This exemplary embodiment will be described with reference to FIG. 32.

Figure 32:
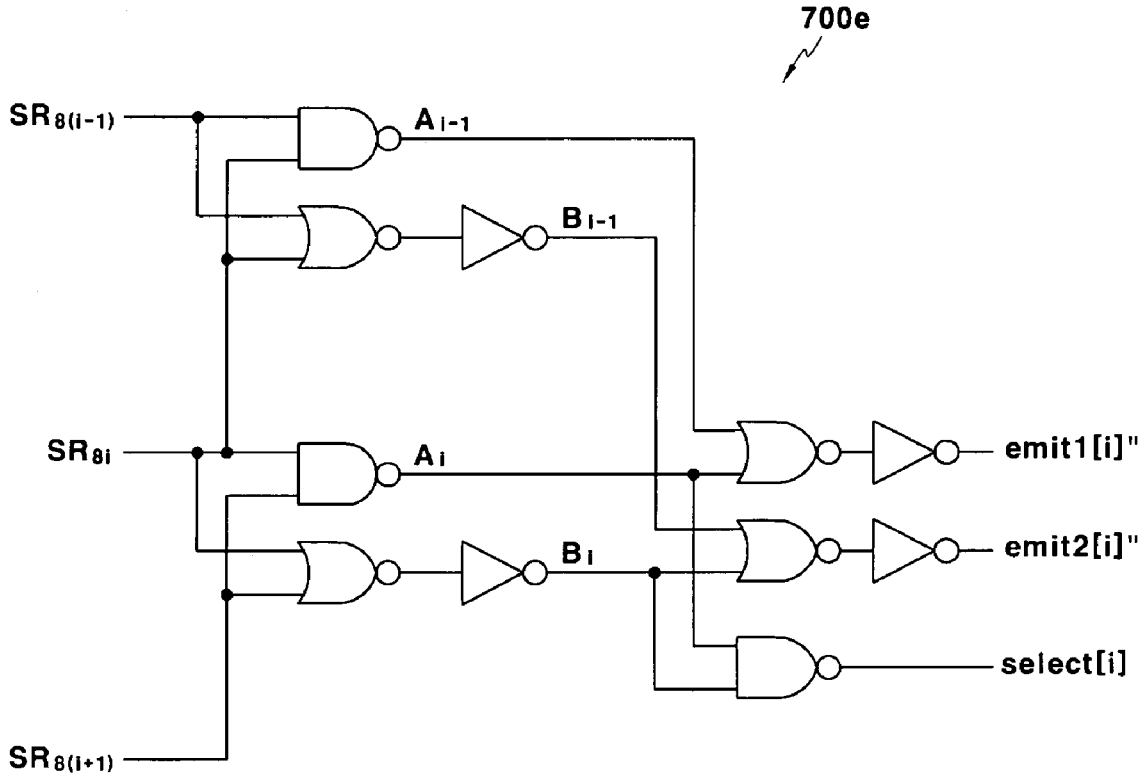

FIG. 32 shows a scan driver 700*e* in an organic light emitting display according to a fifteenth exemplary embodiment. Referring to FIG. 32, the NAND operation of the output signal $A_i$ of the $i^{th}$ NAND gate and the output signal $B_i$ of the $i^{th}$ inverter is performed so that the select signal select[i] is output as shown in FIG. 28.

Figure 33:
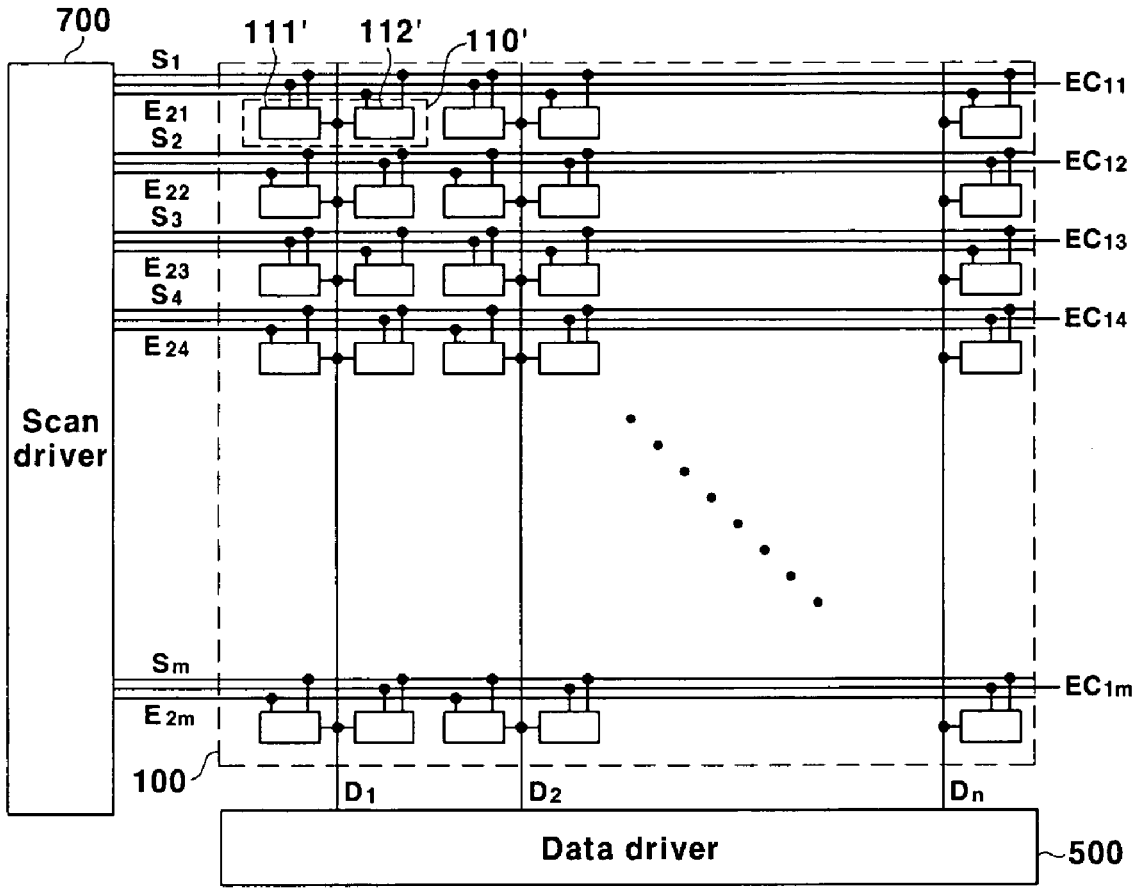
FIG. 33 shows a plan view of an organic light emitting display according to a sixteenth exemplary embodiment of the present invention.

As shown in FIG. 33, the scan driver according to the ninth to fifteenth exemplary embodiments may be applicable to the organic light emitting display shown in FIG. 13. FIG. 33 shows a plan view of the organic light emitting display according to a sixteenth exemplary embodiment of the present invention.

Referring to FIG. 33, as shown in FIG. 13, the emit scan line $E_{1i}$ is coupled to the left pixels 111' of the pixel areas 110' on the $i^{th}$ row (where 'i' is an odd integer of less than 'm') and the emit scan line $E_{2i}$ is coupled to the right pixels 112' of the pixel areas 110' on the $i^{th}$ row, the emit scan line $E_{1(i+1)}$ is coupled to the right pixels 112' of the pixel areas 110' on the $(i+1)^{th}$ row and the emit scan line $E_{2(i+1)}$ is coupled to the left pixels 112' of the pixel areas 110' on the $(i+1)^{th}$ row. In addition, the emit scan lines $E_{1i}$, $E_{2i}$, $E_{1(i+1)}$, $E_{2(i+1)}$ are coupled to the scan driver 700.

Figure 34:
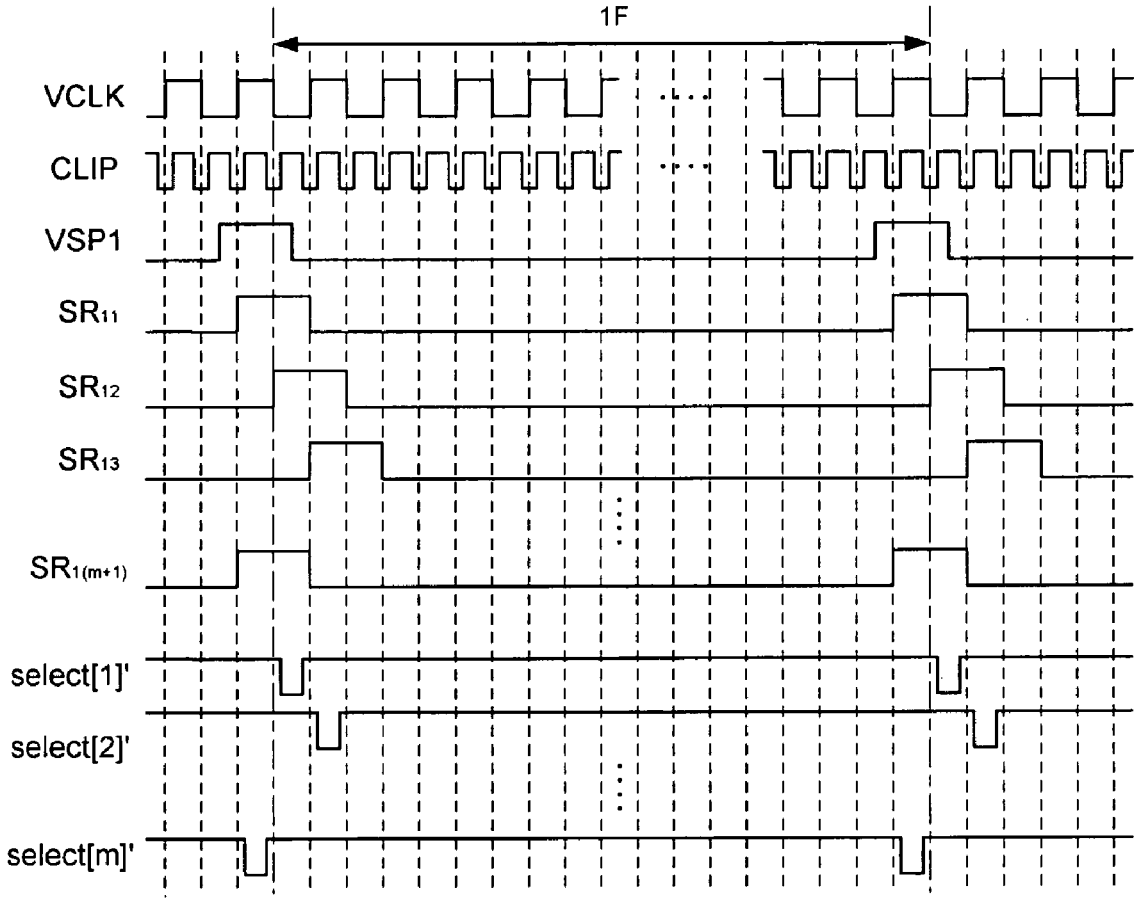
FIG. 34 shows a signal timing diagram in a select scan driver according to a seventeenth exemplary embodiment of the present invention.

In the above exemplary embodiments, the case in which the rising edge of the select signal select[i−1] corresponds to the falling edge of the select signal select[i] is described, but the falling edge of the select signal select[i] may be apart from the rising edge of the select signal select[i−1]. For example, a clip signal CLIP may be input to the NAND gate $NAND_{4i}$ shown in FIG. 4A. As shown in FIG. 34, the clip signal CLIP has a cycle corresponding to the half clock VCLK cycle, and has the low-level pulse whose width is shorter than the half clock VCLK cycle. In addition, the low-level period of the clip signal CLIP includes the falling edge or the rising edge of the clock VCLK. Then, the low-level pulse width of the select signal select[i]' becomes shorter than the half clock VCLK cycle. That is, the falling edge of the select signal select[i]' is apart from the rising edge of the select signal select[i−1]' by the low-level pulse width of the clip signal CLIP.

In the above exemplary embodiments, the case in which the select signal and the emission control signals provided by the scan drivers 200, 300, 400, 600, and/or 700 are directly applied to the select line and the emit lines is shown, but buffers may be formed between the display area 100 and the scan drivers 200, 300, 400, 600, and/or 700. In addition, level shifters which change the levels of the select signal and the emission control signals may be formed between the display area 100 and the scan drivers 200, 300, 400, 600, and/or 700.

According to the exemplary embodiments of the present invention, the two pixels can be driven by common driving and switching transistors and capacitors, thereby reducing the number of data lines. As a result, the number of integrated circuits for driving the data lines can be reduced, and the aperture ratio in the pixel is improved.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display comprising:

a display area comprising a plurality of data lines for transmitting data signals for displaying an image, a plurality of first scan lines for transmitting first signals, a plurality of second scan lines and a plurality of third scan lines for respectively transmitting second signals and third signals, and a plurality of pixel areas, each of the pixel areas comprising a first pixel and a second pixel coupled to a corresponding one of the data lines and a corresponding one of the first scan lines;

a scan driver for transmitting the first signals to the first scan lines, the first signals shifted from each other and each having a first pulse in each of a plurality of subfields for forming a field, for sequentially transmitting the second signals to the second scan lines during a first subfield of the field, the second signals shifted from each other and each having a second pulse at least partially overlapping with the first pulse in the first subfield of the plurality of subfields, and for sequentially transmitting the third signals to the third scan lines during a second subfield of the field after the first subfield, the third signals shifted from each other and each having a third pulse at least partially overlapping with the first pulse in the second subfield of the plurality of subfields; and a driver for driving the first pixel and the second pixel, the driver comprising a driving transistor having an electrode coupled to a power line, wherein the first pixel emits light in response to the second pulse and the second pixel emits light in response to the third pulse, wherein the first pixel comprises a first light emitting element, and a first emission control switch between the driver and the first light emitting element, the first emission control switch controlled by the second pulse and for supplying a current to the first light emitting element, wherein the second pixel comprises a second light emitting element, and a second emission control switch between the driver and the second light emitting element, the second emission control switch controlled by the third pulse and for supplying a current to the second light emitting element, wherein the driving transistor is configured to provide current from the power line through the driving transistor to the first light emitting element and the second light emitting element alternately to emit light, wherein the scan driver comprises a first driver for transmitting the first signals to the first scan lines, the first signals shifted from each other by a first period, and wherein the first driver comprises:

a second driver for outputting fourth signals, the fourth signals shifted from each other by the first period, the fourth signals each having a fourth pulse during a second period being longer than the first period in each of the plurality of subfields; and a third driver for generating a pulse corresponding to the first pulse in at least part of a period during which two of the fourth signals shifted by the first period have their respective fourth pulses overlapped in time.

2. The display of claim 1, wherein one of the data signals corresponding to the first pixel is transmitted to a corresponding one of the data lines when the first pulse is transmitted to a corresponding one of the first scan lines in the first subfield, and another one of the data signals corresponding to the second pixel is transmitted to the corresponding data line when the first pulse is transmitted to the corresponding first scan line in the second subfield.

3. The display of claim 1, wherein the second driver comprises a plurality of flip-flops, an output of a forward flip-flop is an input of a backward flip-flop, and the backward flip-flop outputs a corresponding one of the fourth signals by shifting another one of the fourth signals output from the forward flip-flop by the first period.

4. The display of claim 1, wherein the scan driver comprises:

a fourth driver for transmitting the second signals to the corresponding second scan lines; and a fifth driver for transmitting the third signals to the corresponding third scan lines.

5. The display of claim 4, wherein a period during which the second pulse is applied to a corresponding one of the second scan lines of the first pixel comprises a period during which the first pulse is applied to a corresponding one of the first scan lines of the first pixel; and a period during which the third pulse is applied to a corresponding one of the third scan lines of the second pixel comprises a period during which the first pulse is applied to the first scan line of the second pixel.

6. The display of claim 5, wherein the fourth driver and the fifth driver respectively comprise a plurality of flip-flops, an output of a forward flip-flop is an input of a backward flip-flop, the backward flip-flop of the fourth driver outputs a pulse corresponding to the second pulse by shifting a pulse corresponding to the second pulse of one of the second signals output from the forward flip-flop of the fourth driver by the first period, and the backward flip-flop of the fifth driver outputs a pulse corresponding to the third pulse by shifting a pulse corresponding to the third pulse of one of the third signals output from the forward flip-flop of the fifth driver by the first period.

7. The display of claim 4, wherein:

the fourth driver transmits the second pulse to a corresponding one of the second scan lines of the first pixel after the first pulse transmitted to a corresponding one of the first scan lines of the first pixel ends, and the fifth driver transmits the third pulse to a corresponding one of the third scan lines of the second pixel after the first pulse transmitted to the first scan line of the second pixel ends.

8. The display of claim 7, wherein the fourth driver comprises:

a sixth driver for outputting fifth signals, the fifth signals shifted from each other by the first period, the fifth signals each having a fifth pulse and a sixth pulse inverted to the fifth pulse in a field; and a seventh driver for generating a pulse corresponding to the second pulse in a period during which two of the fifth signals shifted by the first period have their respective fifth pulses overlapped in time.

9. A display comprising a plurality of first scan lines for transmitting first signals, a plurality of second scan lines for transmitting second signals, and a plurality of third scan lines for transmitting third signals, the display comprising:

a first driver for outputting the first signals, the first signals shifted from each other by a first period, the first signals each having a first pulse during a second period in each of a plurality of subfields forming a field;

a second driver for sequentially outputting the second signals during a first subfield of the field, the second signals shifted from each other by the first period, the second signals each having a second pulse at least partially overlapping with the first pulse during a third period longer than the second period in the first subfield of the plurality of subfields;

a third driver for sequentially outputting the third signals during a second subfield of the field after the first subfield, the third signals shifted from each other by the first period, the third signals each having a third pulse at least partially overlapping with the first pulse during a fourth period longer than the second period in the second subfield of the plurality of subfields;

a plurality of data lines for transmitting data signals for displaying an image; and a plurality of pixel areas, wherein each of the pixel areas comprises:

a pixel driver for programming one of the data signals applied in response to the first pulse of one of the first signals;

a first light emitting element for emitting light corresponding to the programmed data signal in response to the second pulse of one of the second signals;

a first emission control switch between the pixel driver and the first light emitting element, the first emission control switch controlled by the second pulse and for supplying a current from the pixel driver to the first light emitting element;

a second light emitting element for emitting light corresponding to the programmed data signal in response to the third pulse of one of the third signals;

a second emission control switch between the pixel driver and the second light emitting element, the second emission control switch controlled by the third pulse and for supplying a current from the pixel driver to the second light emitting element, wherein the pixel driver comprises a driving transistor having an electrode coupled to a power line, the driving transistor for providing current from the power line through the driving transistor to the first light emitting element and the second light emitting element alternately to emit light, wherein the first driver comprises:

a fourth driver for outputting fourth signals, the fourth signals shifted from each other by the first period, the fourth signals each having a fourth pulse in each of the plurality of subfields; and a fifth driver for generating a pulse corresponding to the first pulse in at least part of a period during which two of the fourth signals shifted by the first period have their respective fourth pulses overlapped in time.

10. The display of claim 9, wherein the second driver comprises:

a sixth driver for outputting fifth signals, the fifth signals shifted from each other by the first period, the fifth signals each having a fifth pulse and a sixth pulse inverted to the fifth pulse in a field; and a seventh driver for generating a pulse corresponding to the second pulse in a period during which two of the fifth signals shifted by an integral multiple of the first period have their respective fifth pulses overlapped in time.

11. The display of claim 9, wherein the second driver comprises:

a sixth driver for outputting fifth signals, the fifth signals shifted from each other by the first period, the fifth signals each having a fifth pulse and a sixth pulse inverted to the fifth pulse in a field; and a seventh driver for generating a pulse corresponding to the second pulse in a period during which at least one of two of the fifth signals shifted by an integral multiple of the first period has the fifth pulse.

12. A driving method of a display comprising a first scan line, a second scan line, a third scan line, a data line for transmitting a data signal for displaying an image, and a pixel area defined by the first, second, and third scan lines, and the data line, a driver for driving the pixel area, the driver comprising a driving transistor having an electrode coupled to a power line, a first emission control switch between the driver and a first pixel of the pixel area, the first pixel comprising a first light emitting element, and a second emission control switch between the driver and a second pixel of the pixel area, the second pixel comprising a second light emitting element, the driving method comprising:

outputting a select signal having a first pulse during a first period in each of a plurality of subfields forming a field;

outputting a first emission control signal having a second pulse during a second period longer than the first period in a first subfield of the plurality of subfields; and outputting a second emission control signal having a third pulse during a third period longer than the first period in a second subfield of the plurality of subfields, outputting first signals, the first signals shifted from each other by a fourth period, the first signals each having a fourth pulse in each of the plurality of subfields; and generating the first pulse in at least part of a period during which two of the first signals shifted by the fourth period have their respective fourth pulses overlapped in time, wherein the data signal is programmed to the pixel area in response to a pulse corresponding to the first pulse transmitted to the first scan line, the first pixel of the pixel area starts emitting light corresponding to the programmed data signal in response to a pulse corresponding to the second pulse transmitted to the second scan line, and the second pixel of the pixel area starts emitting light corresponding to the programmed data signal in response to a pulse corresponding to the third pulse transmitted to the third scan line, wherein the first emission control switch supplies a current from the power line through the driving transistor to the first light emitting element while the first emission control signal is being output, and the second emission control switch supplies a current from the power line through the driving transistor to the second light emitting element while the second emission control signal is being output, and wherein the second emission control signal corresponds to a signal inverted to the first emission control signal.

13. The driving method of claim 12, further comprising:

outputting second signals, the second signals shifted from each other by the fourth period, the second signals each having a fifth pulse and a sixth pulse inverted to the fifth pulse in a field; and generating the second pulse in a period during which two of the second signals shifted by an integral multiple of the fourth period have their respective fifth pulses overlapped in time.

14. The driving method of claim 13, further comprising:

generating the third pulse in a period during which two of the second signals shifted by an integral multiple of the fourth period have their respective sixth pulses overlapped in time.

* * * * *